US008186076B2

(12) United States Patent
Takagi

(10) Patent No.: US 8,186,076 B2
(45) Date of Patent: May 29, 2012

(54) DRYING APPARATUS AND DRYING METHOD FOR HONEYCOMB FORMED BODY

(75) Inventor: Shuichi Takagi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 13/042,740

(22) Filed: Mar. 8, 2011

(65) Prior Publication Data

US 2011/0241263 A1 Oct. 6, 2011

(30) Foreign Application Priority Data

Mar. 30, 2010 (JP) ..... 2010-078166

(51) Int. Cl.
*F26B 3/34* (2006.01)

(52) U.S. Cl. ..... 34/264; 34/265; 34/201; 34/218; 219/746; 219/749; 264/489; 425/171.4

(58) Field of Classification Search ..... 34/259, 34/264, 265, 90, 201, 218, 242, 413; 219/746, 219/749; 264/489; 425/171.4
See application file for complete search history.

(56) References Cited

U.S. PATENT DOCUMENTS

| | | | | |
|---|---|---|---|---|
| 3,276,138 | A * | 10/1966 | Fritz | 34/263 |
| 4,629,849 | A | 12/1986 | Mizutani et al. | |
| 7,117,871 | B2 * | 10/2006 | Hancock et al. | 131/65 |
| 2002/0093123 | A1 | 7/2002 | Miura et al. | |
| 2002/0109269 | A1 | 8/2002 | Miura et al. | |
| 2003/0057204 | A1 * | 3/2003 | Minobe et al. | 219/699 |
| 2004/0104514 | A1 | 6/2004 | Ishikawa et al. | |
| 2007/0006480 | A1 | 1/2007 | Ishii et al. | |
| 2009/0166355 | A1 * | 7/2009 | Brundage et al. | 219/696 |
| 2011/0120991 | A1 * | 5/2011 | Armenta Pitsakis | 219/702 |
| 2011/0224945 | A1 * | 9/2011 | Shim et al. | 702/150 |
| 2011/0241263 | A1 * | 10/2011 | Takagi | 264/489 |
| 2011/0297670 | A1 * | 12/2011 | Caggiano | 219/687 |

FOREIGN PATENT DOCUMENTS

| | | | |
|---|---|---|---|
| DE | 4028720 | A1 * | 4/1991 |
| EP | 1835249 | A1 * | 9/2007 |
| JP | 61-013497 | U1 | 1/1986 |
| JP | 2000-044326 | A1 | 2/2000 |
| JP | 2002-283330 | A1 | 10/2002 |
| JP | 2004-167809 | A1 | 6/2004 |
| JP | 2008134036 | A * | 6/2008 |
| JP | 2010076328 | A * | 4/2010 |
| WO | 2005/023503 | A1 | 3/2005 |

* cited by examiner

*Primary Examiner* — Stephen M. Gravini
(74) *Attorney, Agent, or Firm* — Burr & Brown

(57) ABSTRACT

A drying apparatus for honeycomb formed bodies includes: a drying chamber having a drying space to store undried honeycomb formed bodies; a microwave generator that generates microwaves; and a plurality of waveguides for introducing the microwaves into the drying chamber. On side surfaces of the drying chamber, provided is a plurality of microwave introduction ports for introducing the microwaves generated by the microwave generator into the drying space inside the drying chamber, the waveguides are disposed at the microwave introduction ports, and irradiation ports of the waveguides are provided directed to two or more different directions toward the drying space of the drying chamber.

11 Claims, 20 Drawing Sheets

△WATER AMOUNT DIFFERENCE=②-①

DRYING APPARATUS AND DRYING METHOD FOR HONEYCOMB FORMED BODY

FIELD OF THE INVENTION

The present invention relates to a drying apparatus and a drying method for honeycomb formed bodies.

RELATED BACKGROUND OF THE INVENTION

A honeycomb structure made of ceramics has been widely used for catalyst carriers, various filters, etc. Recently, the structure has particularly attracted the attention as a diesel particulate filter (DPF) for trapping particulate matters (PM) discharged from a diesel engine.

Such a honeycomb structure can generally be obtained by kneading a raw material composition obtained through addition of an auxiliary forming agent and various addition agents to dispersion media, such as a ceramic material and water to form a clay, then extruding the clay into a honeycomb-shaped formed body (honeycomb formed body), drying this honeycomb formed body, and then firing the honeycomb formed body.

As means for drying a honeycomb formed body, there have been known a natural drying method in which the honeycomb formed body is simply left under a room temperature condition, a hot-air drying method in which the honeycomb formed body is dried by hot air generated with a gas burner, and a dielectric drying method in which the honeycomb formed body is dried utilizing high-frequency energy generated by causing a current to flow between electrodes provided at an upper side and a lower side of the honeycomb formed body, but recently, a microwave drying method utilizing microwaves has been performed in place of these drying methods, or in combination with them.

The microwave drying is performed, for example, after an electric field distribution in a drying furnace is made uniform prior to then placing the honeycomb formed bodies to be dried therein. As means for uniformizing the electric field distribution, there is known a method for adjusting a shape and placement of an antenna that radiates microwaves, and a method for using a stirrer fan, etc. As prior art documents on the microwave drying method, Japanese Patent Laid-Open No. 2002-283330, Japanese Patent Laid-Open No. 2004-167809, International Publication Pamphlet 2005/023503, Japanese Patent Laid-Open No. 2000-44326, and Japanese Utility Model Laid-Open No. 1986-13497 are cited.

SUMMARY OF THE INVENTION

However, when the honeycomb formed body is dried with the microwave drying method, it is difficult to dry the whole honeycomb formed body at a uniform speed. In other words, for example, drying the center of the honeycomb formed body may be more delayed than the other portions thereof. Since the honeycomb formed body is shrunk by water evaporation therefrom, when a difference of a drying speed (difference of a water amount) in the inside of the formed body occurs, deformation is caused and the yield is reduced. Moreover, when the honeycomb formed body is dried with the microwave drying method, drying cracks may also occur therein. These problems tend to occur particularly in cases where the honeycomb formed body has a high water content ratio before being dried, with a large size, thick partition walls (with large thickness) and a small opening area of an end surface that is formed of a material with a large dielectric loss, etc.

Although rotation of the honeycomb formed body is effective to uniformly irradiate microwaves thereto, a rotation mechanism causes the drying apparatus to be complicated, expensive and particularly difficult to accomplish in a continuous microwave drying apparatus. In the continuous microwave drying apparatus, it is aimed to average microwave electric field strength in a longitudinal direction of the furnace by moving the honeycomb formed body in a traveling direction to uniformly irradiate the honeycomb formed body with microwaves, but actually, the resulting microwave irradiation becomes non-uniform in some cases. Although arrangement of irradiation ports and reflecting plates are devised, and/or a stirrer fan etc. is used in the prior art documents, it is not easy to achieve uniformization. Therefore, even if the size of a furnace body is made larger, better uniformization can be achieved, but there is a limit to it.

The object of the present invention is to provide a drying apparatus and a drying method for a honeycomb formed body with which the whole honeycomb formed body can be dried at a uniform speed, and with which drying cracks do not easily occur.

The present inventor has found that the above-described problems can be solved by changing the direction of the microwave irradiation ports. Namely, according to the present invention, the following drying apparatus and drying method for honeycomb formed bodies are provided.

According to a first aspect of the present invention, a drying apparatus for a honeycomb formed body is provided, that is capable of obtaining a dried honeycomb formed body by irradiating with microwaves and microwave-heating an undried honeycomb formed body composed of a raw material composition containing a ceramic material and water, and in which a plurality of cells are partitioned and formed by partition walls, thereby evaporating water from the inside and the outside of the undried honeycomb formed body. The drying apparatus includes a drying chamber having a drying space to store the undried honeycomb formed body, a microwave generator generating the microwaves to be irradiated to the undried honeycomb formed body that is stored in the drying chamber is radiated, and a plurality of waveguides for introducing the microwaves generated by the microwave generator into the drying chamber, wherein on the side surfaces of the drying chamber, a plurality of microwave introduction ports are provided for introducing the microwaves generated by the microwave generator into the drying space inside the drying chamber, the waveguides are disposed at the microwave introduction ports, and irradiation ports of the waveguides are directed to two or more different directions toward the drying space of the drying chamber.

According to a second aspect of the present invention, the drying apparatus for the honeycomb formed body according to the first aspect is provided, wherein flanges are formed for removably holding the waveguides provided toward the drying space at the microwave introduction ports on the side surfaces of the drying chamber.

According to a third aspect of the present invention, the drying apparatus for the honeycomb formed body according to the second aspect is provided, wherein the waveguides are formed into a bent shape to change directions of the microwaves in the drying chamber, and have flanges for allowing the flanges to be removable from the flanges of the drying chamber, and the radiation directions of the microwaves can be changed depending on attachment directions of the waveguides to the flanges of the drying chamber.

According to a fourth aspect of the present invention, the drying apparatus for the honeycomb formed body according to any of the first to third aspects is provided, which is a continuous drying apparatus that continuously introduces/discharges a plurality of the honeycomb formed bodies into/from the drying chamber, wherein the irradiation ports of the waveguides are provided parallel or vertical with respect to a conveying direction of the honeycomb formed bodies in the drying chamber.

According to a fifth aspect of the present invention, the drying apparatus for the honeycomb formed body according to the fourth aspect is provided, wherein a percentage of the parallel direction of the waveguides is 30 to 70%.

According to a sixth aspect of the present invention, the drying apparatus for the honeycomb formed body according to the fifth aspect is provided, wherein a percentage of an upstream direction in the conveying direction of the parallelly directed waveguides is 40 to 60%.

According to a seventh aspect of the present invention, the drying apparatus for the honeycomb formed body according to any of the first to third aspects is provided, which is the continuous drying apparatus that continuously introduces/discharges the plurality of the honeycomb formed bodies into/from the drying chamber, wherein the directions of the irradiation ports of the waveguides are set in vertical directions with respect to the conveying direction of the honeycomb formed bodies in the drying chamber and in upward/downward directions to be more upward or downward than the vertical directions, and a percentage of the upward/downward directions is 30 to 70%.

According to an eighth aspect of the present invention, the drying apparatus for the honeycomb formed body according to the seventh aspect is provided, wherein a percentage of the upward waveguides in the upward and downward waveguides is 50%.

According to a ninth aspect of the present invention, a drying method for honeycomb formed bodies using the drying apparatus for the honeycomb formed bodies according to any of the first to eighth aspects is provided, wherein the honeycomb formed bodies are conveyed with an interval therebetween not less than twice as long as a distance between the irradiation ports.

Since the irradiation ports of the waveguides are directed in two or more different directions toward the drying space of the drying chamber, it becomes possible to uniformly dry the honeycomb formed body, thus preventing drying cracks and cell deformation from occurring while enabling a stabilized shape thereof.

| [EXPLANATIONS OF NUMERALS] | |
|---|---|
| 1: | Honeycomb formed body |
| 2: | Partition wall |
| 3: | Cell |
| 4: | Outer wall |
| 21: | Drying apparatus |
| 22: | Drying chamber |
| 22a: | Side surface (of drying chamber) |
| 23: | Microwave introduction port |
| 23a: | Flange (of microwave introduction port) |
| 24: | Conveying pallet |
| 26: | Waveguide |
| 26a: | Flange (of waveguide) |
| 26b: | Bolt hole |
| 26c: | Irradiation port |
| 28: | Belt conveyor |
| 29: | Carry-in entrance |
| 30: | Carry-out exit |
| 35: | Microwave generator |

DETAILED DESCRIPTION OF THE INVENTION

Hereinafter, embodiments of the present invention will be described with reference to the drawings. The present invention is not limited to the following embodiments, they can be changed, modified, and improved while not departing from the scope of the invention.

Figure 1:
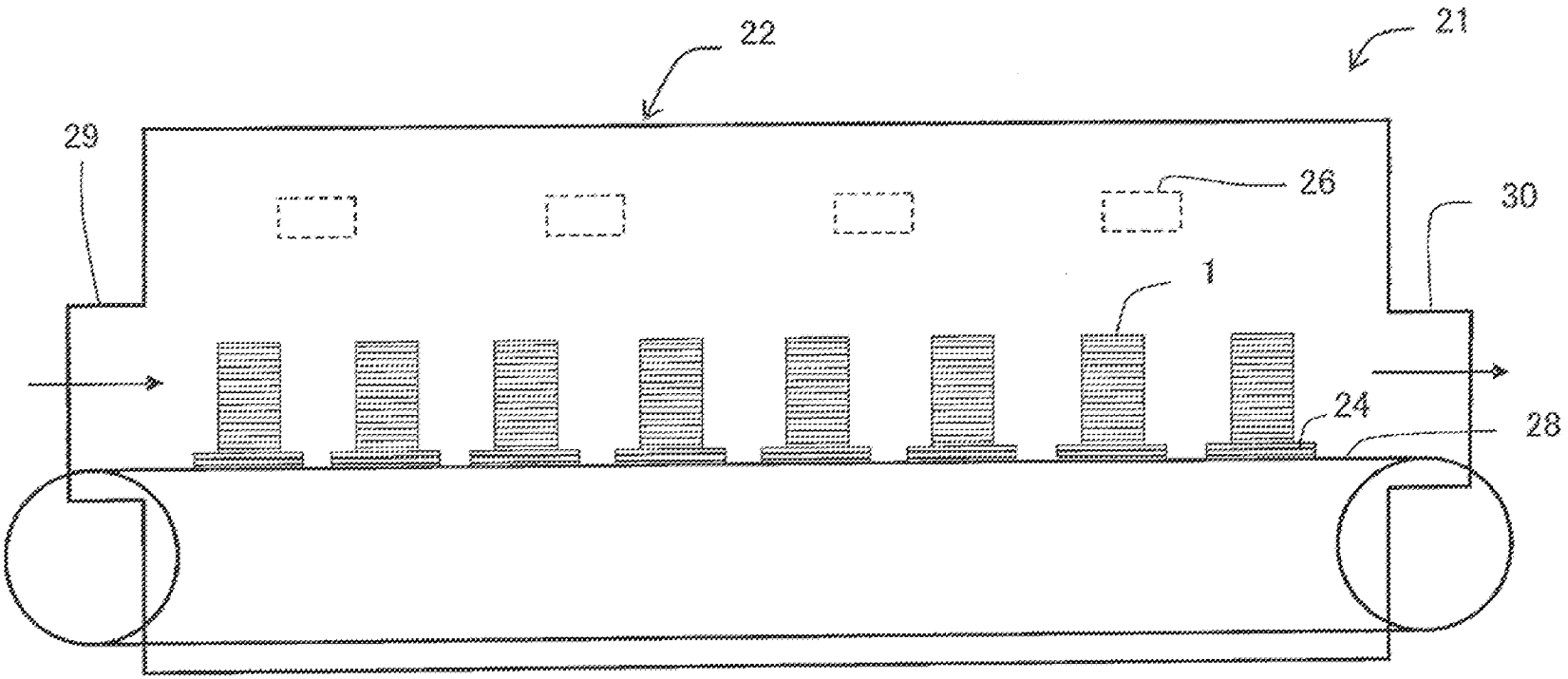
FIG. 1 is a cross-sectional view schematically showing a cross section parallel to a conveying direction of honeycomb formed bodies of one embodiment of a drying apparatus for the honeycomb formed bodies of the present invention.

As shown in FIG. 1, a drying apparatus 21, for a honeycomb formed body 1, of the present invention is capable of obtaining a dried honeycomb formed body by irradiating with microwaves and microwave-heating an undried honeycomb formed body as the undried honeycomb formed body 1 which is comprised of a raw material composition containing a ceramic material and water, and in which a plurality of cells 3 are partitioned and formed by partition walls 2, while evaporating water from the inside and the outside of the undried honeycomb formed body to dry the undried honeycomb formed body. The drying apparatus 21 includes a drying chamber 22 having a drying space to store undried honeycomb formed bodies, a microwave generator 35 generating microwaves to be irradiated to the undried honeycomb formed body that is stored in the drying chamber 22, and a plurality of waveguides 26 for introducing the microwaves generated by the microwave generator 35 into the drying chamber 22. On side surfaces of the drying chamber 22, a plurality of microwave introduction ports 23 are provided for introducing the microwaves generated by the microwave generator 35 into the drying space inside the drying chamber 22, the waveguides 26 are disposed at the microwave introduction ports 23, and irradiation ports 26*c* of the waveguides 26 are directed in two or more different directions toward the drying space of the drying chamber 22.

Figure 2A:
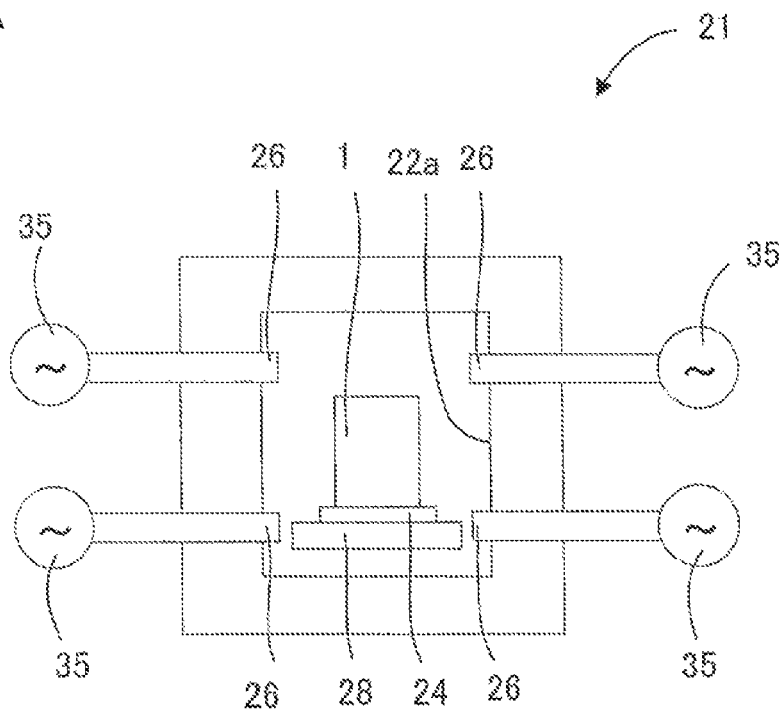
FIG. 2A is a cross-sectional view schematically showing a vertical cross section to the conveying direction of the honeycomb formed bodies of one embodiment of the drying apparatus for the honeycomb formed bodies of the present invention.

FIG. 1 is a cross-sectional view schematically showing a cross section parallel to a conveying direction of the honeycomb formed body 1 of one embodiment of the drying apparatus 21 for the honeycomb formed body 1 of the present invention. FIG. 2A is a cross-sectional view schematically showing a cross section vertical to the conveying direction of the honeycomb formed body 1 of one embodiment of the drying apparatus 21 for the honeycomb formed body 1 of the present invention. The drying apparatus 21 for the honeycomb formed body 1 of the embodiment includes the drying chamber 22 for drying the unfired honeycomb formed body 1 therein, and waveguides 26 at the microwave introduction ports 23 in order to introduce microwaves of the drying chamber 22 into the drying chamber 22.

In addition, the drying chamber 22 includes a belt conveyor 28, and is formed so that conveying pallets 24 may be conveyed from a carry-in entrance 29 toward a carry-out exit 30 of the belt conveyor 28. Subsequently, the honeycomb formed bodies 1 placed on the conveying pallets 24 are thus carried in to be dried in this drying chamber 22. Although the honeycomb formed bodies 1 are conveyed in a state of being aligned in a line within the drying chamber 22 in the embodiment, they may be conveyed in two or more lines, i.e., in a plurality of lines. The drying apparatus 21 for the honeycomb formed bodies 1 of the embodiment is a continuous drying apparatus in which the honeycomb formed bodies 1 are conveyed on the belt conveyor.

In a drying method for the honeycomb formed bodies 1 of the embodiment, microwaves which microwave-heats the unfired honeycomb formed bodies 1 are introduced through the waveguides 26. A frequency of the microwaves is preferably 900 to 30,000 MHz, and particularly preferably 900 to 3,000 MHz.

Figure 2B:
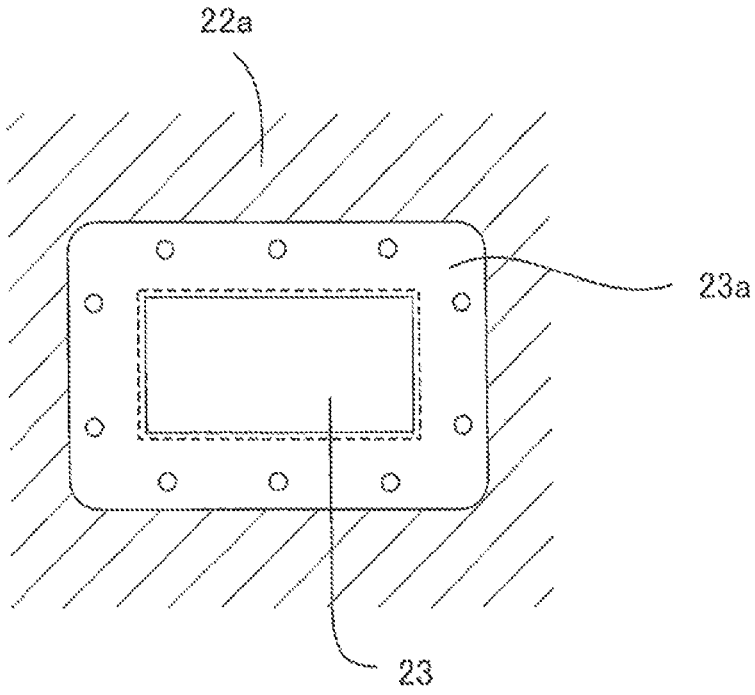
FIG. 2B is a schematic view showing a flange formed at a microwave introduction port on a side surface of a drying chamber.

In FIGS. 3A to 3E, shown are schematic views of the drying apparatus 21 for the honeycomb formed bodies 1 when viewed from above and a side. The microwave introduction ports 23 are formed on side surfaces 22*a* of the drying chamber 22 in the conveying direction. As shown in FIG. 2B, a flange 23*a* for removably holding the waveguide 26 provided toward the drying space is formed at the microwave introduction port 23, and the waveguide 26 is attached to the flange 23*a*. The plurality of microwave introduction ports 23 are provided on the side surfaces 22*a* of the drying chamber 22, and the waveguides 26 are provided at the microwave introduction ports 23 with the irradiation ports 26*c* thereof being directed to the drying space of the drying chamber 22. It is to be noted that the waveguides 26 are not necessarily attached to all the microwave introduction ports 23, and they may be attached to 30 to 70% of all the microwave introduction ports 23.

It is preferable that the plurality of waveguides 26 are partially formed into a bent shape in the drying chamber 22. Namely, it is preferable that the waveguides 26 are configured to be formed into the bent shape in order to change directions of the microwaves, and to have flanges for allowing the flanges to be removable from the flanges of the drying chamber 22. Configuration as described above enables irradiation directions of the microwaves to be changed depending on the attachment direction of the waveguides 26 to the flanges 23*a* of the microwave introduction ports 23.

Figure 4:
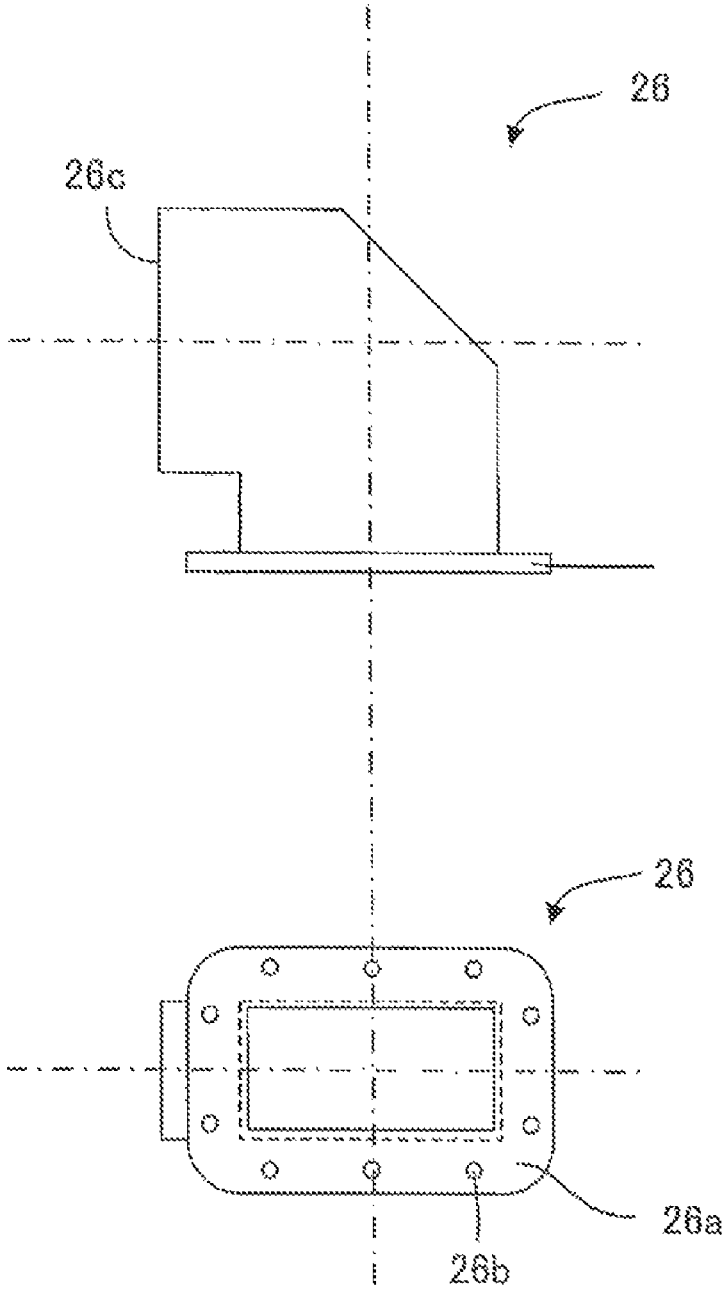
FIG. 4 is a view showing one embodiment of a waveguide.

An embodiment of the waveguide 26 is shown in FIG. 4. The waveguide 26 shown in FIG. 4 is a bent waveguide 26 formed into the bent shape so that an exit direction of the microwaves may change by 90 degrees with respect to an entry direction thereof. The waveguide 26 in FIG. 4 has a flange 26*a* formed at one opening end thereof, bolt holes 26*b* are formed on the flange 26*a*, so that the waveguide 26 can be attached to the flange of the drying chamber 22 with bolts. The bent shape can use an H corner for parallelly directed waveguides, and an E corner for upwardly or downwardly directed waveguides. Note that the E corner can be used for parallelly directed waveguides depending on the direction of the opening 23 of a furnace body.

Figure 3A:
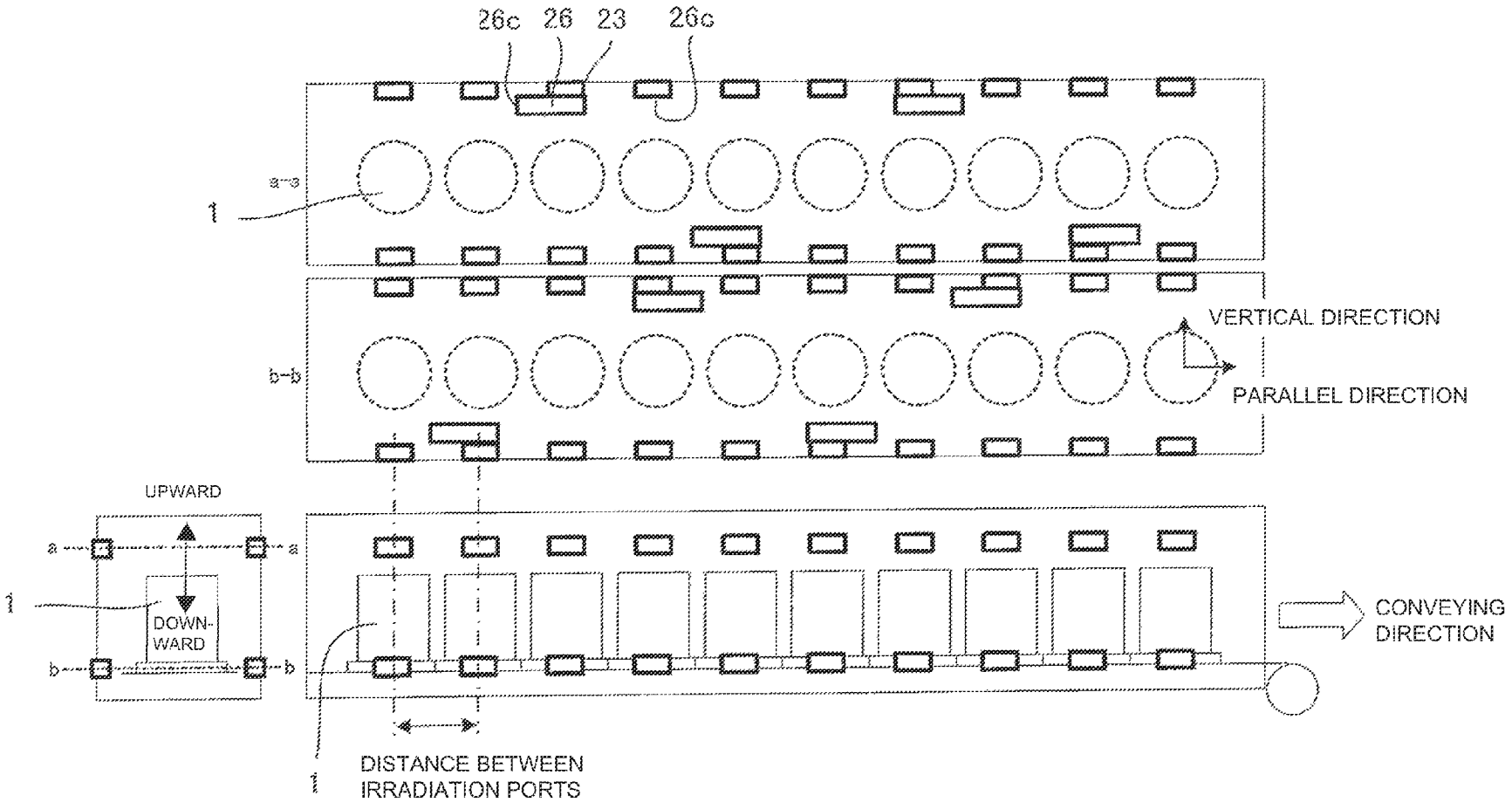
FIG. 3A is a schematic view showing arrangement of waveguides of a first embodiment when the drying apparatus for the honeycomb formed bodies of the present invention is viewed from above and a side.
Figure 3B:
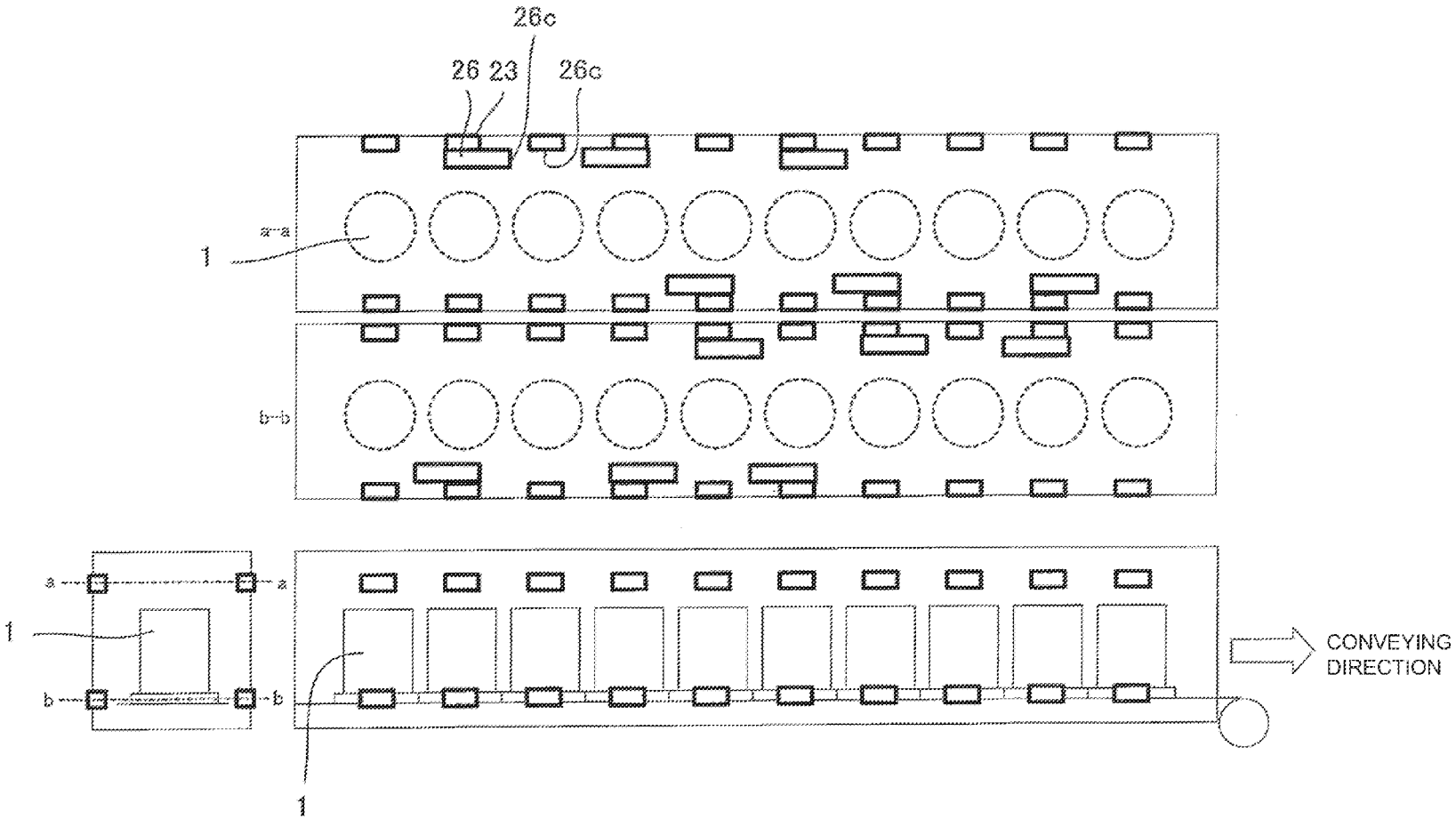
FIG. 3B is a schematic view showing arrangement of waveguides of a second embodiment when the drying apparatus for the honeycomb formed bodies of the present invention is viewed from above and a side.

The drying apparatus 21 for the honeycomb formed bodies 1 of the present invention is a continuous drying apparatus in which the plurality of honeycomb formed bodies 1 are continuously introduced/discharged into/from the drying chamber 22, and where it is preferable to configure the directions of the irradiation ports 26*c* of the waveguides 26 to be parallel or vertical with respect to the conveying direction of the honeycomb formed bodies 1 in the drying chamber 22, in which a percentage of parallel directions (parallel directions/(parallel directions+vertical directions)) is 30 to 70%. FIG. 3A shows an embodiment configured so that a percentage of the irradiation ports 26*c* of the waveguides 26 are directed to be parallel with respect to the conveying direction of the honeycomb formed bodies 1 in the drying chamber 22 may be 20%. In addition, FIG. 3B shows an embodiment in which a percentage of the parallel directions is 30%, FIG. 3C; 50%, FIG. 3D; 70%, and FIG. 3E; 80%, respectively. It is to be noted that as shown in FIG. 3A, the conveying direction of the honeycomb formed bodies 1 indicates the parallel direction, and a direction vertical to the conveying direction (horizontal direction crossing a belt of the belt conveyor 28) indicates the vertical direction. In addition, when the waveguides 26 are not attached to the microwave introduction ports 23, microwaves are irradiated in the vertical direction. In the respective embodiments, such examples are shown that the directions of the irradiation ports 26*c* are either parallel or vertical, and that the irradiation ports 26*c* are arranged so as not to be inclined to the respective directions. The drying apparatus 21 in which the directions of the irradiation ports 26*c* of the waveguides 26 are set to be parallel and vertical is suitable when the honeycomb formed body 1 is conveyed in a state where one of the opening end surfaces thereof is placed vertically and downwardly on a drying tray (conveying pallet 24) (vertically placed).

Figure 10A:
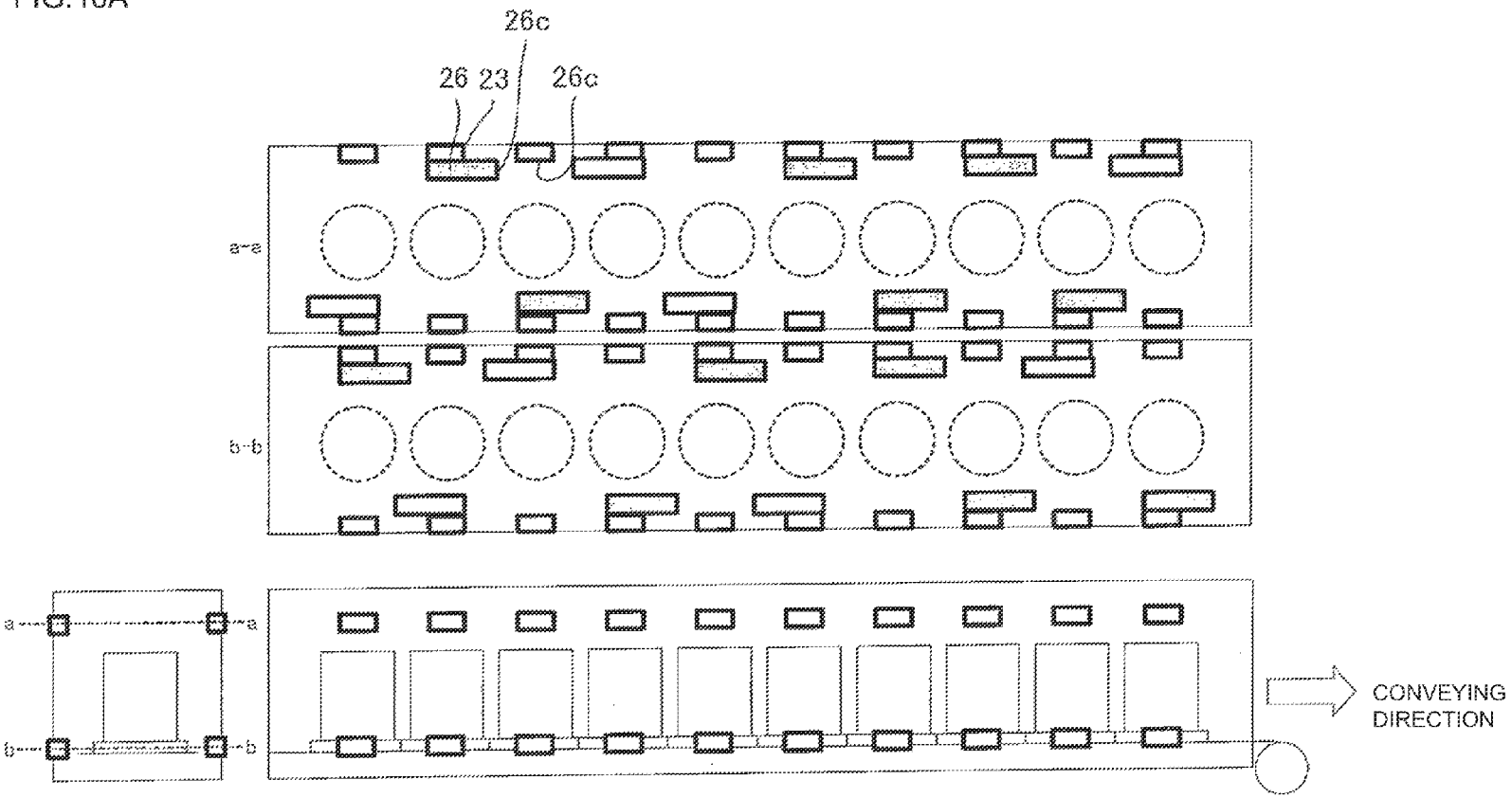
FIG. 10A is a schematic view showing arrangement of waveguides of an embodiment in which a percentage of parallelly directed waveguides is 50%, and a percentage of upstream directed waveguides is 40%.
Figure 10B:
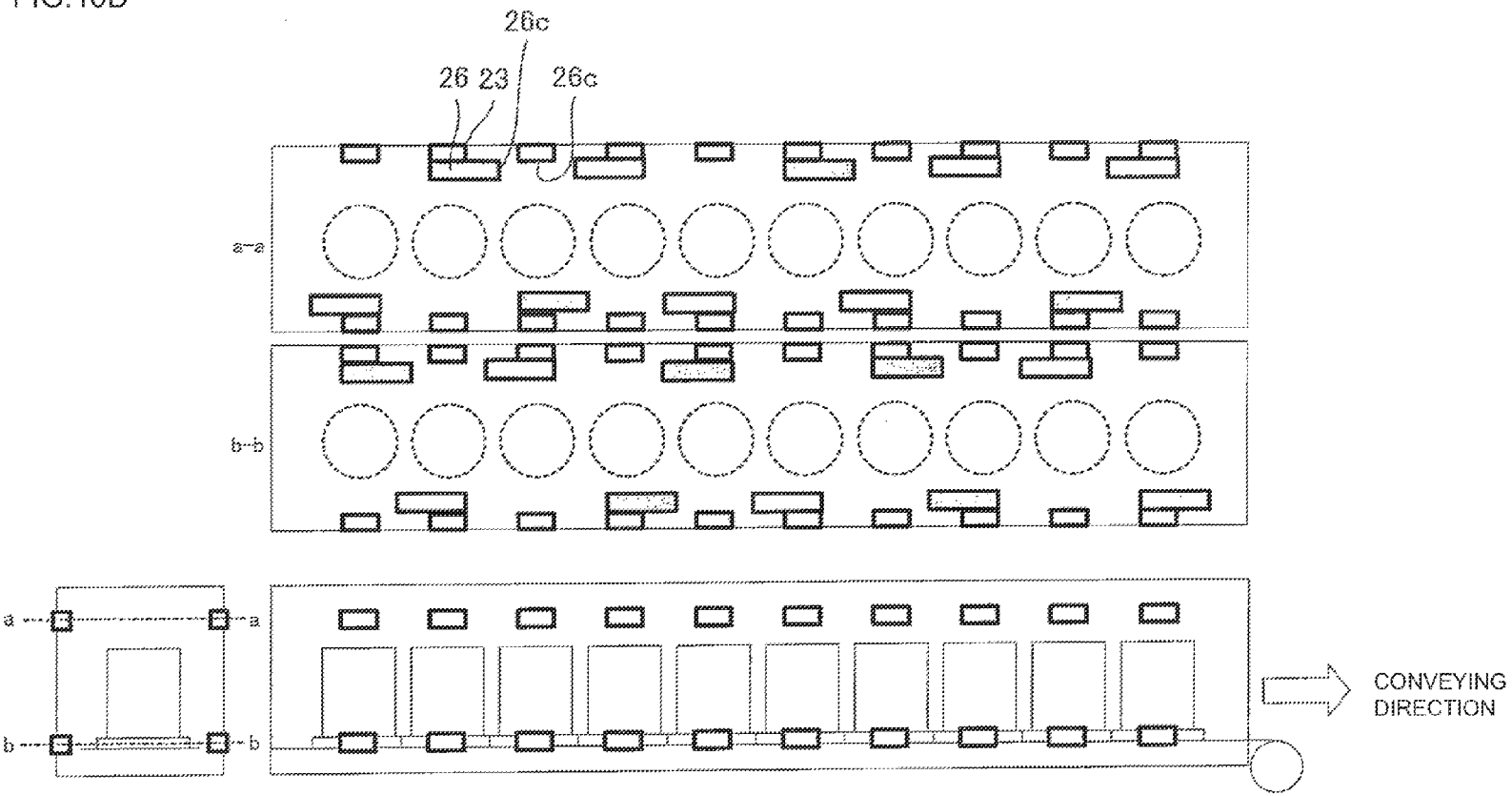
FIG. 10B is a schematic view showing arrangement of waveguides of an embodiment in which a percentage of parallelly directed waveguides is 50%, and a percentage of upstream directed waveguides is 60%.

It is preferable that directions of the waveguides 26 are set to be parallel or vertical with respect to the conveying direction of the honeycomb formed bodies 1 in the drying chamber 22, in which a percentage of the parallel directions (parallel directions/(parallel directions+vertical directions)) are set to be 30 to 70%, it is preferable that a percentage of the upstream direction in the conveying direction of the parallelly directed waveguides 26 (upstream directions/(upstream directions+downstream directions)) is 30 to 70%, more preferable 40 to 60%, and the most preferable 50%. Namely, it is the most preferable that a percentage of the upstream directions and that of the downstream directions are 50-50%. For example, FIGS. 3A to 3E show an embodiment in which the percentage of the upstream directions is 50%. In addition, in FIG. 10A, shown is an embodiment in which the percentage of the upstream directions is 40%, and in FIG. 10B, shown is an embodiment in which the percentage of the upstream directions is 60%

Figure 9A:
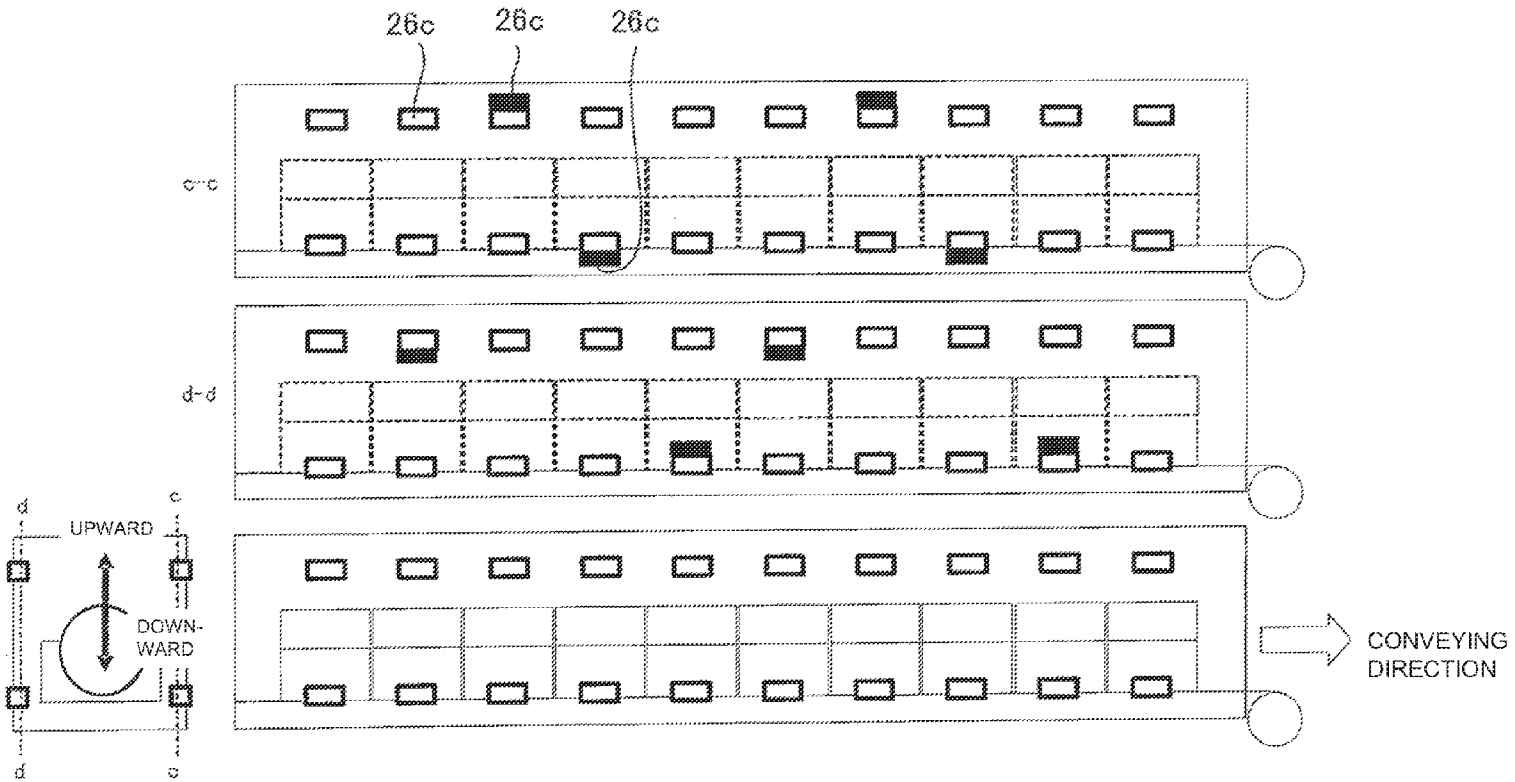
FIG. 9A is a schematic view showing arrangement of waveguides of an embodiment in which a percentage of upwardly and downwardly directed waveguides is 20%.
Figure 9B:
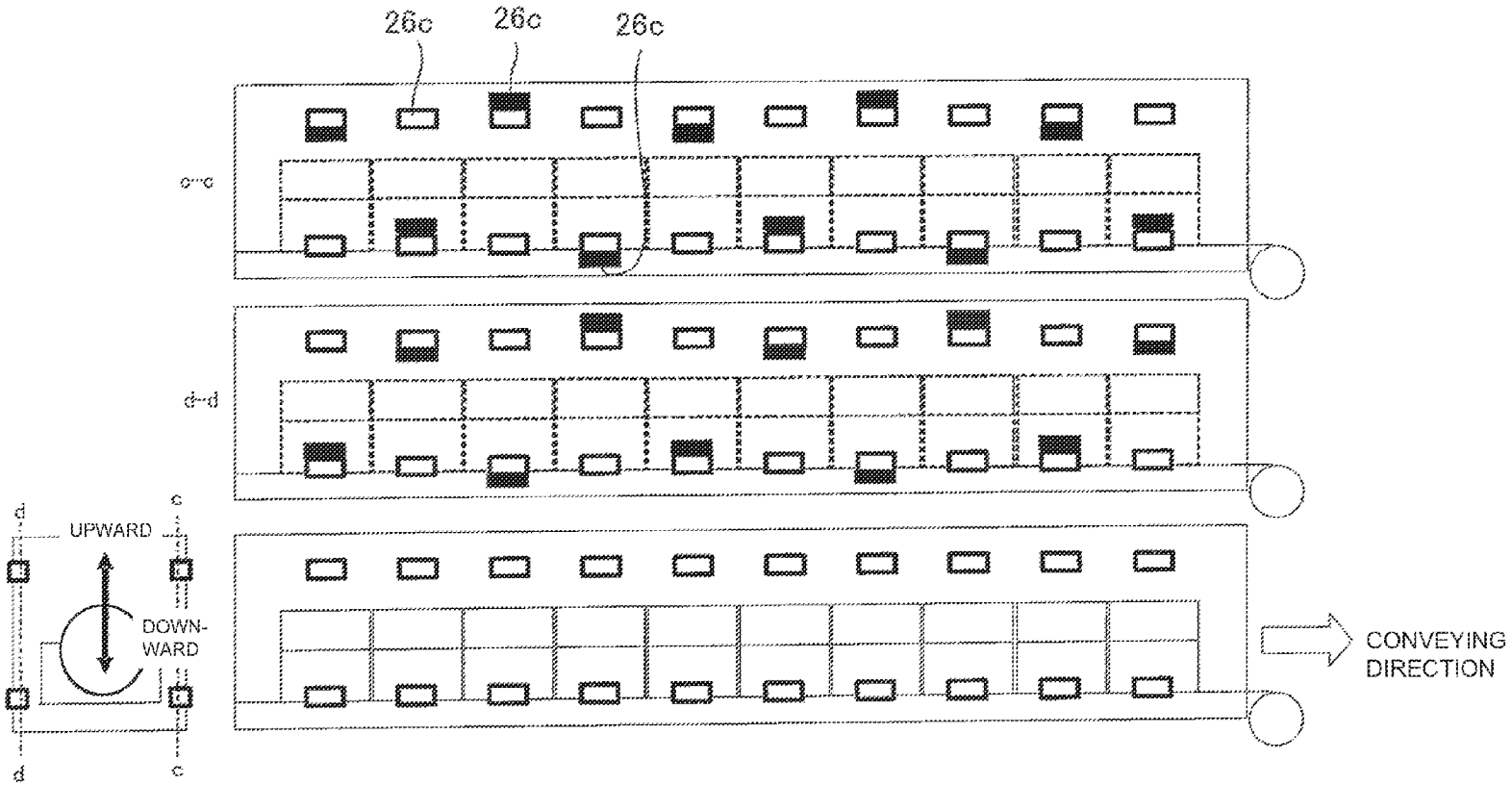
FIG. 9B is a schematic view showing arrangement of waveguides of an embodiment in which a percentage of upwardly and downwardly directed waveguides is 50%.

In addition, the drying apparatus 21 for the honeycomb formed bodies 1 of the present invention is a continuous drying apparatus in which the plurality of honeycomb formed bodies 1 are continuously introduced/discharged into/from the drying chamber 22, and it is preferable to configure the directions of the irradiation ports 26*c* of the waveguides 26 to be set in vertical directions with respect to the conveying direction of the honeycomb formed bodies 1 in the drying chamber 22, and in upward/downward directions that are more upward or downward than the vertical directions, and a percentage of the upward and downward directions (upward directions/(upward directions downward directions)) is 30 to 70%. In FIG. 9A, shown is an embodiment in which the percentage of the upward and downward directions is 20%, and in FIG. 9B, shown is an embodiment in which the percentage of the upward and downward directions is 50%. The drying apparatus 21 in which the directions of the irradiation ports 26*c* of the waveguides 26 are set to be vertical, and upward and downward, is suitable when the honeycomb formed body 1 is conveyed and placed on the drying tray (conveying pallet 24) so that one of the opening end surfaces thereof may be in a state of being directed to the conveying direction thereof (laterally placed).

It is preferable that the percentage of the upward directions of the upwardly and downwardly directed waveguides 26 is 30 to 70%, more preferable 40 to 60%, and the most preferable 50%. Namely, it is the most preferable that the percentage of the upward directions and that of the downward directions are 50-50%. FIGS. 9A and 9B show an embodiment in which the percentage of the upward directions is 50%.

The inside of the drying chamber 21 is formed with a metal box so that microwave energy introduced into the drying space may not leak out. It is preferable to use SUS as a material of the metal box from the viewpoint of ease of welding, and rustproofing.

Figure 6A:
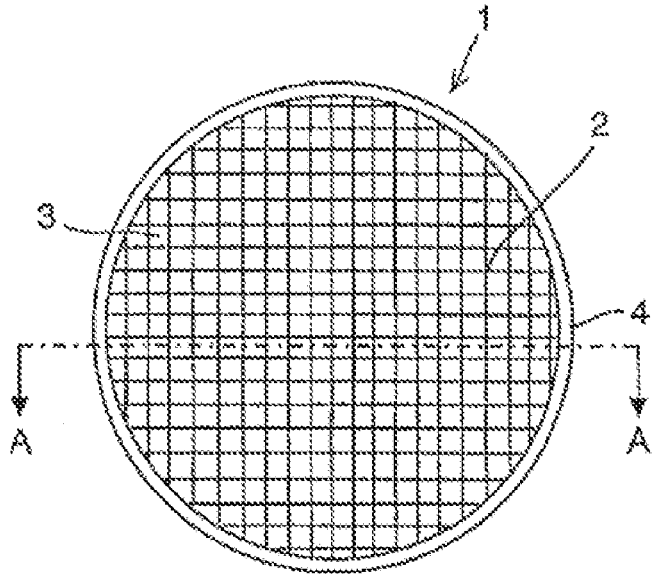
FIG. 6A is a view showing one example of a honeycomb formed body, which is a body to be dried with the drying method for the honeycomb formed bodies according to the present invention, in which an end surface is viewed in an axial direction.
Figure 6B:
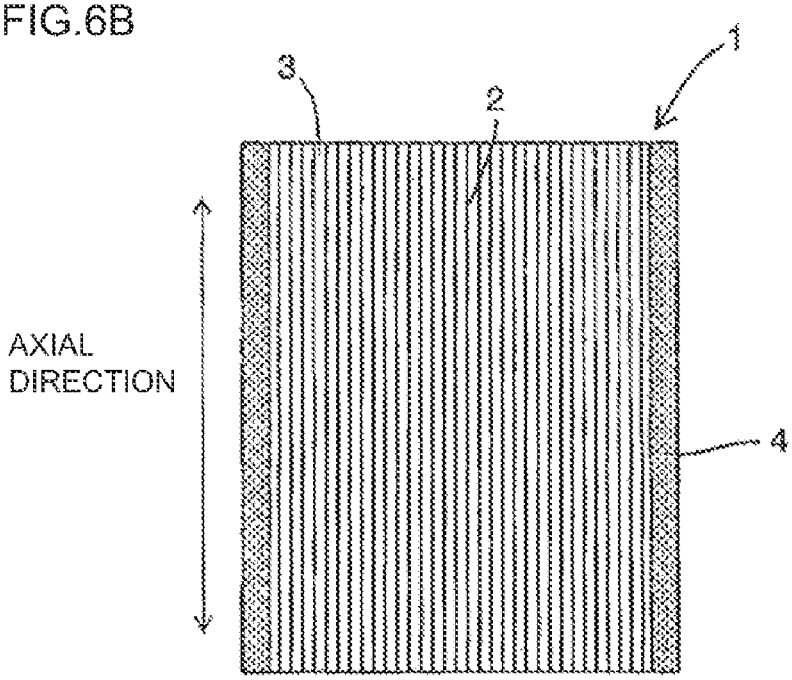
FIG. 6B is a cross-sectional view showing an A-A cross section in FIG. 6A.

Next will be described the honeycomb formed body 1 that is dried by the drying method for honeycomb formed bodies according to the present invention. The honeycomb formed body 1 shown in FIGS. 6A and 6B is one example of honeycomb formed bodies, and it is a honeycomb-shaped formed body (honeycomb formed body 1) having the plurality of cells 3 that is partitioned by the partition walls 2 that serve as fluid through channels. In this honeycomb formed body 1, an outer wall 4 is disposed on an outer periphery so as to surround the plurality of cells 3, and an outline shape of the honeycomb formed body 1 is a cylinder. The honeycomb formed body 1 has a quadrangular shape of a cross section perpendicular to an axial direction (through-channel direction) of the cells 3. It is to be noted that the shape of the honeycomb formed body 1 to be dried by the drying apparatus 21 and the drying method of the present invention is not limited to the one shown in FIGS. 6A and 613, and it may be a shape, for example, another prismatic shape, such as a triangle pole and a hexagonal column, a cylinder, an elliptic column, etc. In addition, a shape of the cell 3 of the honeycomb formed body 1 is not limited, either and, for example, there can be included a cell shape, such as a quadrangle cell, a hexagon cell, a triangle cell, a circular cell. Further, the honeycomb formed body 1 may be a plugged honeycomb formed body (HAC (High Ash Capacity) honeycomb formed body) in which a size of a cell opening of one end surface is different from that of the other end surface.

The honeycomb formed body 1 can be obtained as follows: kneaded clay is a raw material made by adding water as a dispersion medium, an auxiliary forming agent, and an addition agent to a ceramic material; and after that, for example, the clay is extrusion-formed.

The honeycomb formed body 1 before being dried (undried honeycomb formed body) is preferably an unfired one (referred to as an unfired body) of not less than 20% by mass and not more than 60% by mass. The unfired body means that the body is in a state where particles of the used ceramic material exist while maintaining a form of particle at the time of forming, and where the ceramic material has not been sintered.

As the ceramic material, for example, there can be included oxide-based ceramics, such as a raw material made into cordierite, alumina, mullite, and zirconia, or non-oxide-based ceramics, such as silicon carbide, silicon nitride, aluminum nitride, aluminum titanate, lithium aluminum titanate, and $Al_4SiC_4$, etc. Moreover, it is possible to use a composite material of silicon carbide/metal silicon, and a composite material of silicon carbide/graphite, etc.

As the auxiliary forming agent (binder), there can be included, for example, polyvinyl alcohol, polyethylene glycol, starch, methylcellulose, carboxymethylcellulose, hydroxyethylcellulose, hydroxypropylmethylcellulose, polyethylene oxide, sodium polyacrylate, polyacrylamide, polyvinyl butyral, ethylcellulose, cellulose acetate, polyethylene, ethylene-vinyl acetate copolymer, polypropylene, polystyrene, acrylic resin, polyamide resin, glycerin, polyethylene glycol, dibutyl phthalate, etc.

Above are specific examples of the ceramic material that constitutes the outer wall 4 disposed on the outer periphery in the honeycomb formed body 1, similar ceramic materials to the above can be included.

Note that in a manufacturing method of a honeycomb structure obtained by firing the honeycomb formed body 1, after drying, includes a method for manufacturing a honeycomb structure in which partition walls 2 and an outer wall surrounding them are integrally formed, and a method for manufacturing a honeycomb structure having an outer wall by processing an outer periphery of the partition walls 2 after forming them, by newly coating a surface of the processed outer periphery with a cement coat layer with an aggregate formed of a ceramic material. The honeycomb formed body 1 shown in FIGS. 6A and 6B is the honeycomb formed body 1 as an intermediate body in the former manufacturing method, and in the case of the latter manufacturing method, the honeycomb formed body 1 to be dried does not have an outer wall.

In the embodiments shown in FIGS. 3A to 3E, the honeycomb formed bodies 1 are carried into the drying chamber 22 through the carry-in entrance 29 with the same interval between the honeycomb formed bodies 1 as the interval between the microwave introduction ports 23 in the conveying direction. Subsequently, the honeycomb formed bodies 1 are heated to be dried with microwaves while being conveyed in the conveying direction. According to the drying apparatus 21 for the honeycomb formed body 1 of the present invention, it is possible to dry the whole honeycomb formed body 1 at a uniform speed since the microwaves in the drying chamber 22 are more uniform than in a conventional apparatus, and thus drying cracks do not easily occur in the honeycomb formed body 1.

Figure 5A:
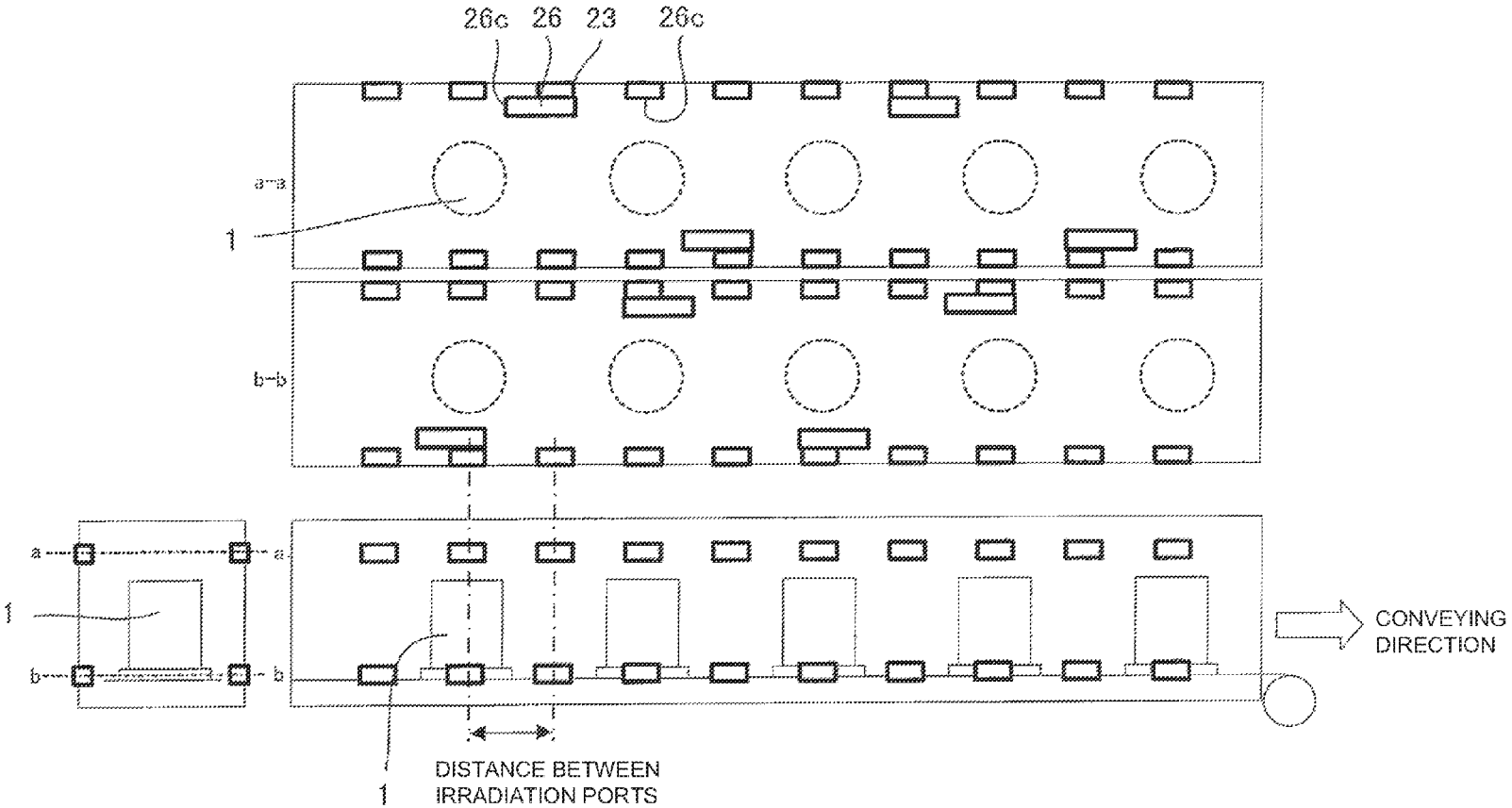
FIG. 5A is a schematic view for illustrating a drying method for honeycomb formed bodies of the present invention, in which a conveying interval thereof is changed.
Figure 5B:
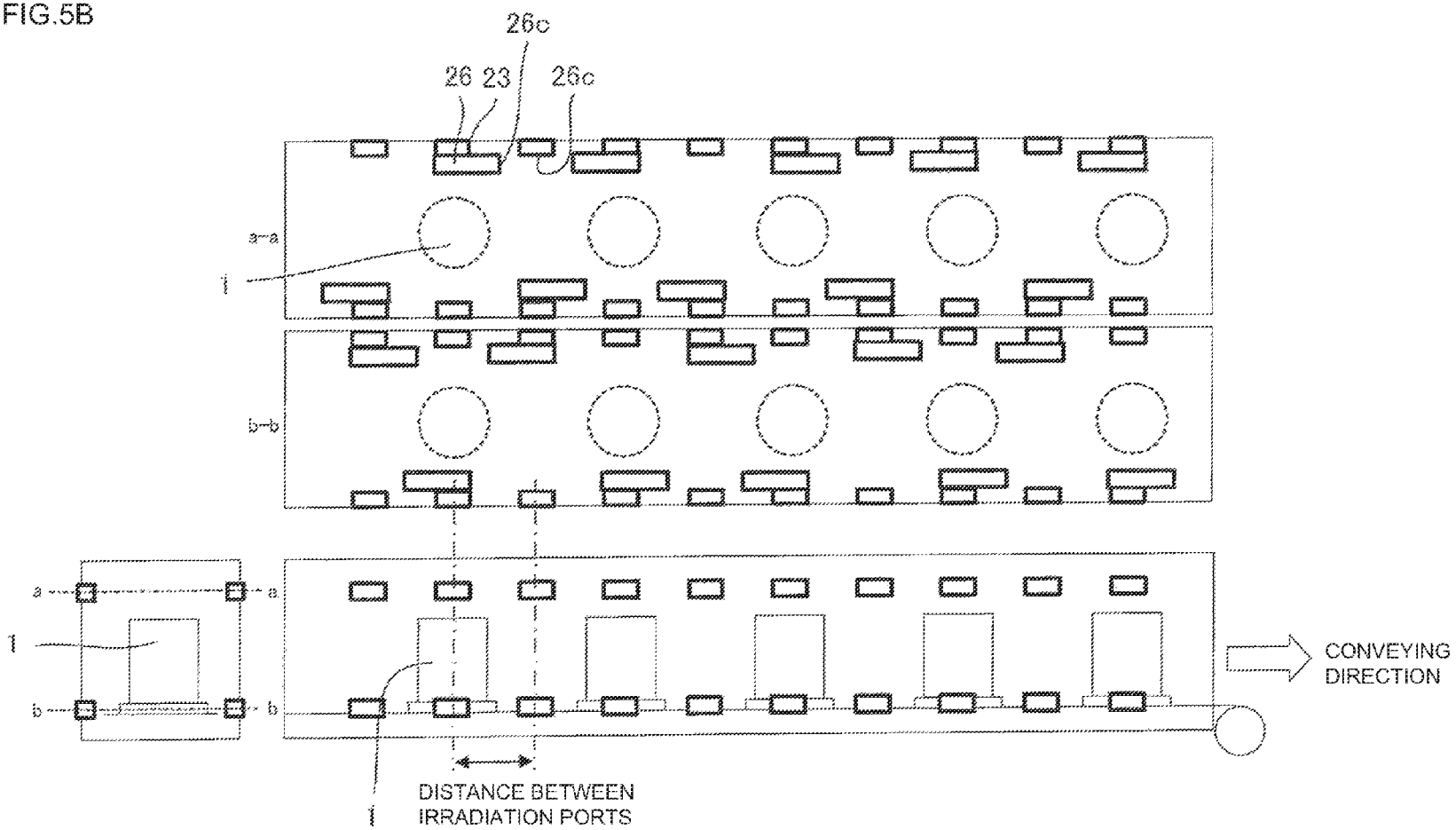
FIG. 5B is a schematic view showing another embodiment for illustrating the drying method for the honeycomb formed bodies of the present invention, in which a conveying interval thereof is changed.

In the drying method for honeycomb formed bodies of the present invention, the honeycomb formed bodies 1 are dried while being conveyed with a unit pitch (distance between the irradiation ports), or conveyed with not less than twice the unit pitch in a continuous drying apparatus. In the drying method for the honeycomb formed bodies using the drying apparatus 21 for the honeycomb formed bodies 1 of the present invention, it is preferable to convey the honeycomb formed bodies 1 with an interval therebetween that is not less than twice a distance between the irradiation ports 26*c* (the interval is not limited to an integral multiple, but may be 2.5 times etc.). In FIGS. 5A and 5B, shown is the drying method for the honeycomb formed bodies 1 in which they are conveyed with the interval therebetween that is not less than twice the distance between the irradiation ports 26*c*. The honeycomb formed bodies 1 are dried while being conveyed with an interval therebetween as described above, thereby enabling the honeycomb formed bodies 1 to dry more uniformly. Particularly, in FIG. 5A showing a case where parallelly directed waveguides are less than 50%, the method, in which the honeycomb formed bodies 1 are conveyed with the interval therebetween that is not less than twice the distance between the irradiation ports 26*c*, has a large effect in uniformly drying the honeycomb formed bodies 1.

EXAMPLES

Hereinafter, the present invention will be described in more detail based on examples, but it is not limited to these examples.

Examples 1 to 7 and Comparative Example 1

[Honeycomb formed body] A cordierite raw material made by mixing alumina, kaolin, and talc was used as a ceramic raw material, and an axially forming agent containing methylcellulose (organic binder), an addition agent containing water-absorbing resin (pore-forming material), and water as a dispersion medium were mixed and kneaded to obtain clay. In this case, the mixed composition was set to be 4 parts by mass of methylcellulose and 2 parts by mass of water-absorbing resin. Subsequently, the obtained clay was extruded to form a honeycomb formed body 1 having a diameter of 360 millimeters, a length (axial length) of 380 millimeters, an outline shape of a cylinder, and a square shape of a cross section perpendicular to a central axis of the cell 3. A cell density of the obtained honeycomb formed body 1 was 300 cells/in$^2$ (in indicates an inch, which is 2.54 centimeters by SI unit system), and an opening area of an end surface was 70% of an area of the whole end surface (opening area ratio was 0.7). Moreover, a thickness of the partition wall 2 was 0.31 millimeter. A mass of the honeycomb formed body 1 was 29.5 kg, and a water content ratio thereof was 27%.

[Drying method] Microwave drying was performed on the obtained honeycomb formed body 1 for 15 minutes using the microwave drying apparatus 21 shown in FIGS. 1 and 2A in which the frequency was set to be 2450 MHz, and the output was 20 kW/piece. It is to be noted that in Examples 1 to 7, waveguides were used and placement of the honeycomb formed body as shown in FIGS. 3A to 3E and 5A to 5B, where the honeycomb formed body 1 was conveyed in a state where one of the opening end surfaces thereof was placed vertically and downwardly on the drying tray (conveying pallet 24), and in Comparative Example 1, the placement used were those shown in FIG. 8A (refer to Table 1).

Figure 7A:
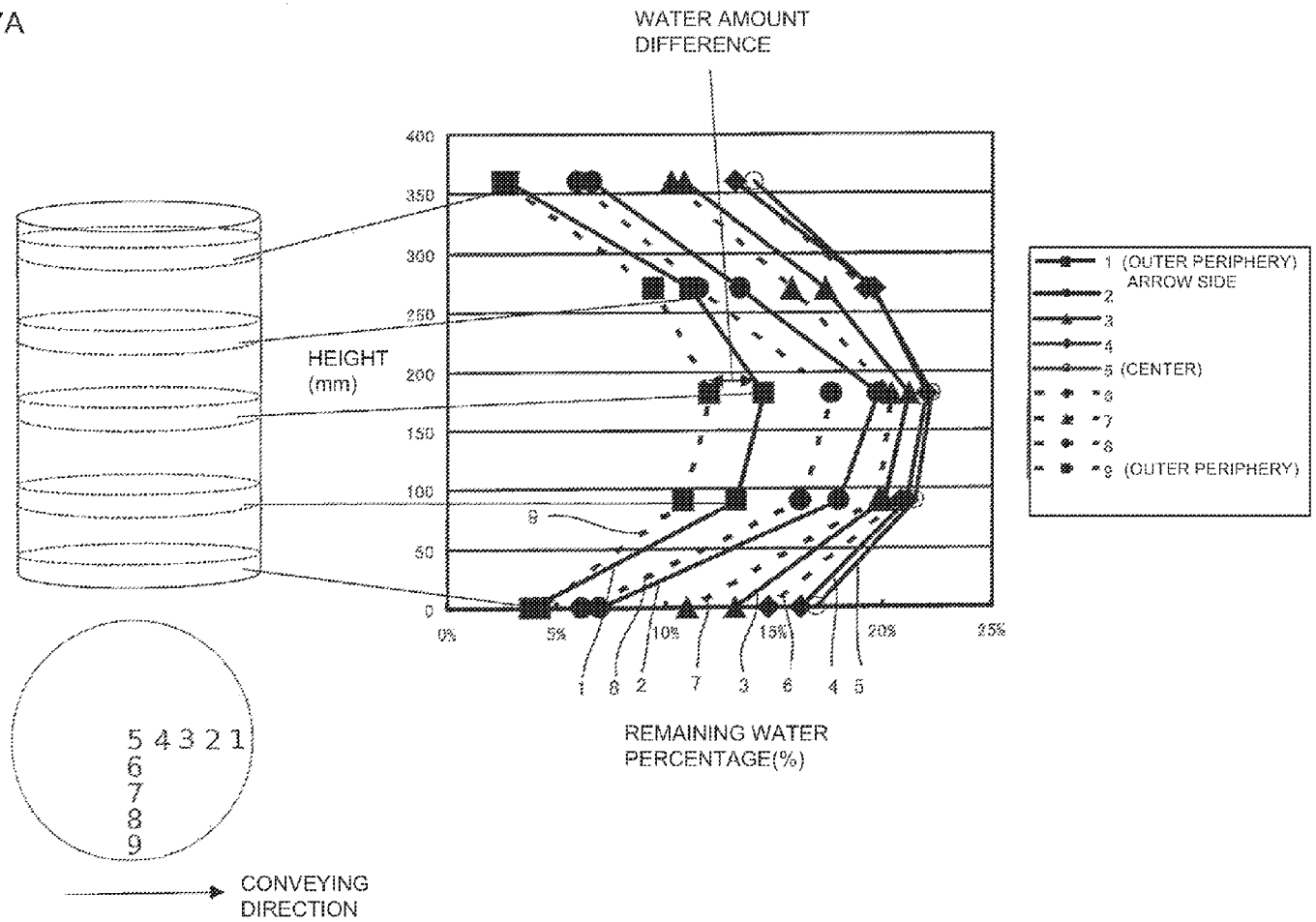
FIG. 7A is a graph having a view therewith for illustrating an evaluation method of the drying method for the honeycomb formed bodies of the present invention.

[Evaluation] The honeycomb formed body 1 on which microwave drying was performed was sliced into five disks in an axial direction (height direction) as shown in FIG. 7A, and nine samples were sliced whose sliced size was 10 by 10 by 10 millimeters in the respective disks. A remaining water percentage was then calculated as follows. First, a mass of a weighing bottle was measured (Ag), and next, the sample was put into the weighing bottle to measure amass (Bg). Subsequently, after the sample was heated and dried for three hours by a small dryer in which a temperature was set to be 105° C., it was moved to a desiccator to be cooled, and a mass thereof was measured (Cg). The remaining water percentage was calculated by substituting the respective values into the following equation.

$$\text{Remaining water percentage}=(B-C)\div(B-A)\times 100$$

Since a difference of remaining water percentages in an outer periphery position (measurement positions 1 and 9) is large as shown in FIG. 7A, a maximum water amount difference between in the measurement position 1 and in the measurement position 9 was defined as a water amount difference. In addition, presence/absence of cracks in the honeycomb formed body 1 after the microwave drying was confirmed by visual observation.

The results are shown in Table 1.

TABLE 1

Figure 3C:
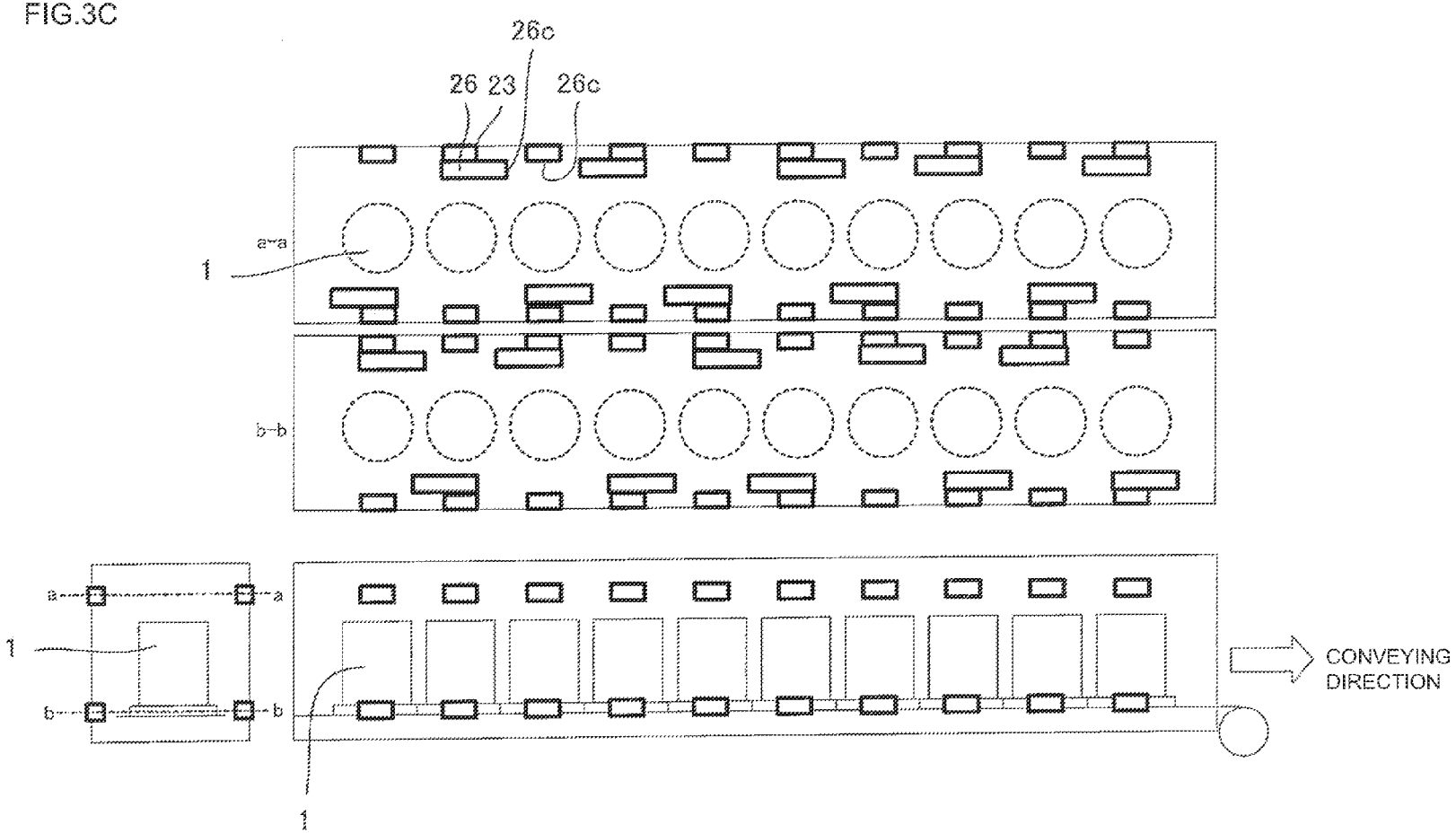
FIG. 3C is a schematic view showing arrangement of waveguides of a third embodiment when the drying apparatus for the honeycomb formed bodies of the present invention is viewed from above and a side.
Figure 3D:
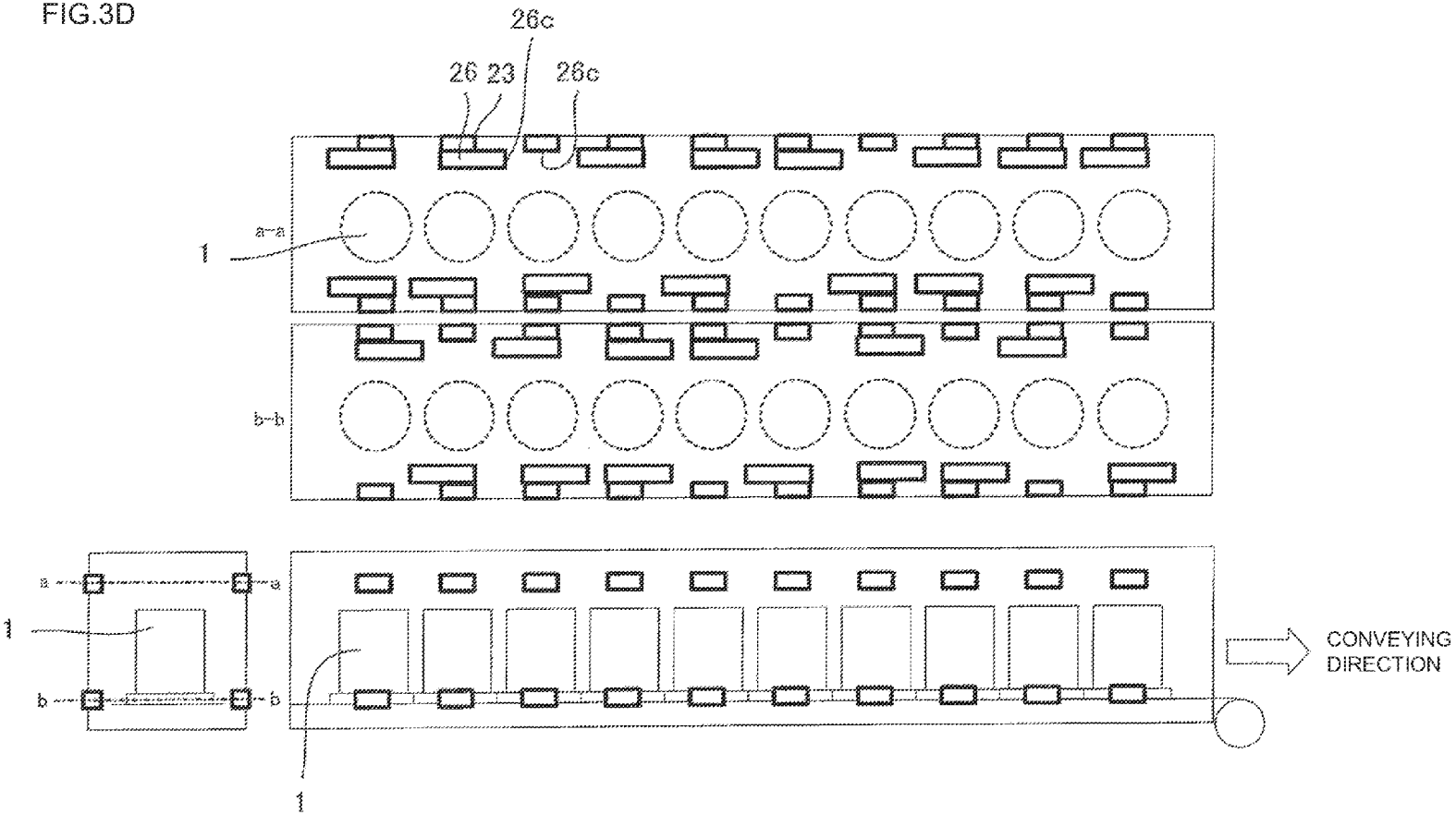
FIG. 3D is a schematic view showing arrangement of waveguides of a fourth embodiment when the drying apparatus for the honeycomb formed bodies of the present invention is viewed from above and a side.
Figure 3E:
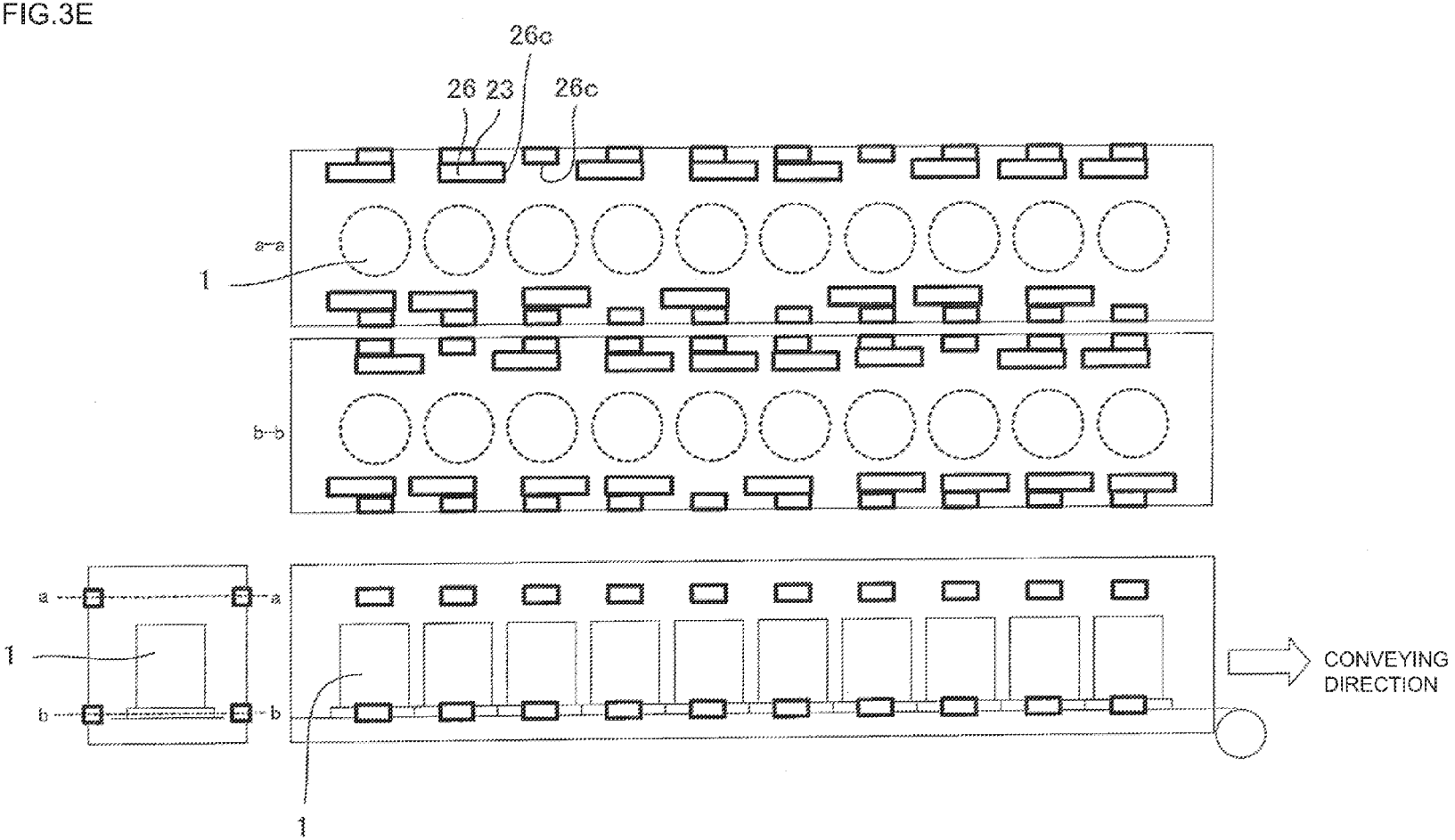
FIG. 3E is a schematic view showing arrangement of waveguides of a fifth embodiment when the drying apparatus for the honeycomb formed bodies of the present invention is viewed from above and a side.
Figure 8A:
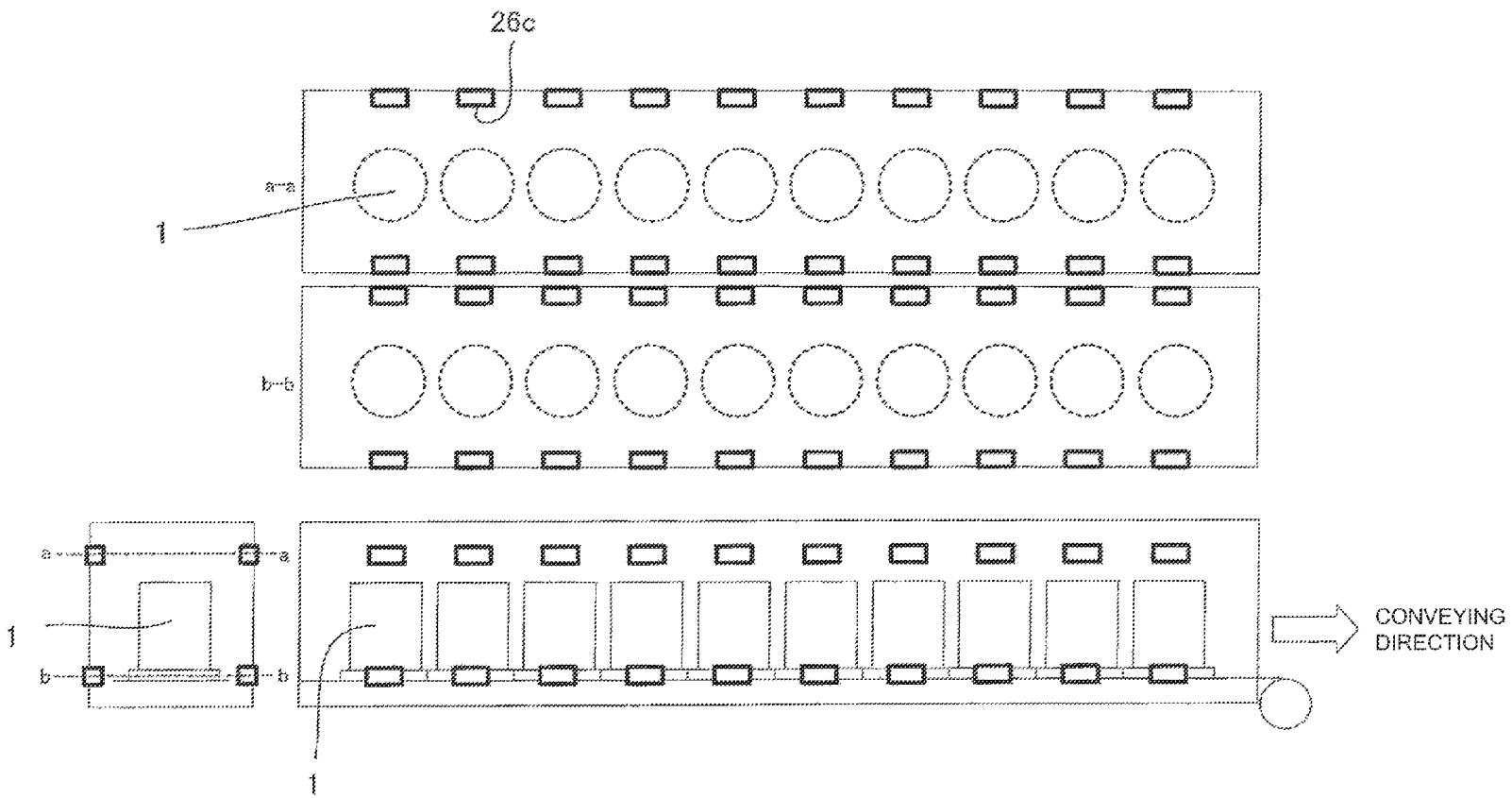
FIG. 8A is a schematic view showing arrangement of waveguides when a conventional drying apparatus for honeycomb formed bodies is viewed from above, in which an embodiment is shown that conveys honeycomb formed bodies in a state of being vertically placed.

| | Corresponding drawing | Percentage of parallel directions | The number of upstream directions | The number of downstream directions | Percentage of upstream directions | Water amount difference | The number of cracks |
|---|---|---|---|---|---|---|---|
| Comparative Example 1 | FIG. 8A | 0% | 0 | 0 | 0% | 15% | 10/11 pieces |
| Example 1 | FIG. 3A | 20% | 4 | 4 | 50% | 10% | 6/11 pieces |
| Example 2 | FIG. 3B | 30% | 6 | 6 | 50% | 7% | 0/10 pieces |
| Example 3 | FIG. 3C | 50% | 10 | 10 | 50% | 0% | 0/10 pieces |
| Example 4 | FIG. 3D | 70% | 14 | 14 | 50% | −7% | 0/10 pieces |
| Example 5 | FIG. 3E | 80% | 16 | 16 | 50% | −10% | 5/10 pieces |
| Example 6 | FIG. 5A | 20% | 4 | 4 | 50% | 6% | 0/10 pieces |
| Example 7 | FIG. 5B | 50% | 16 | 16 | 50% | −5% | 0/10 pieces |

In Examples 1 to 7 in which the waveguides 26 were provided from which microwaves were radiated parallelly in the conveying direction of the honeycomb formed bodies 1, the number of cracks decreased compared with Comparative Example 1 (refer to FIG. 8A). Particularly, in Examples 2 to 4 in which a percentage of parallelly directed waveguides 26 was 30 to 70%, cracks did not occur, and good results were obtained. In addition, Example 6 (refer to FIG. 5A) shows a case where the honeycomb formed bodies 1 were conveyed to be dried with an interval therebetween being set to be twice in the drying apparatus 21 in which directions of the waveguides 26 were the same in Example 2 (refer to FIG. 3B). Additionally, as with Example 2, the water amount difference and the number of cracks were improved. Similarly in Example 7 (FIG. 5B), the water amount difference and the number of cracks were improved, but a greater water amount difference occurred in Example 7 as compared with Example 3, and thus an improved effect was brought by conveying the honeycomb formed bodies 1 to dry with the interval therebetween being set to be more than twice as large as in Example 6, in which the percentage of the parallelly directed waveguides 26 was less than 50%.

Examples 8 to 12 and Comparative Example 2

Figure 7B:
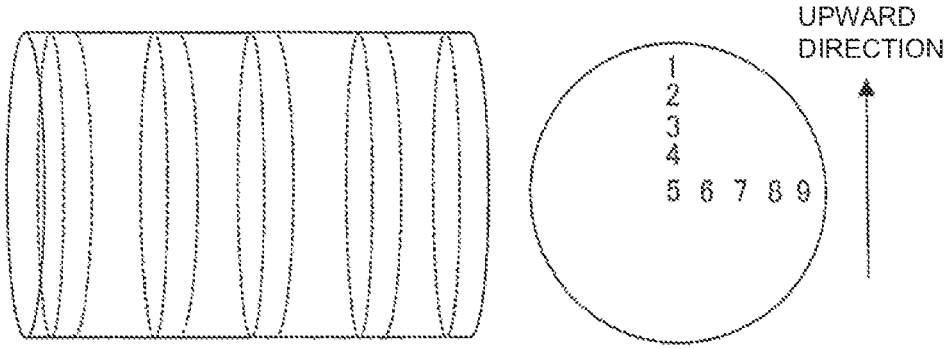
FIG. 7B is a view for illustrating measurement points of water amount differences in Table 2.

Next, microwave drying was performed under a condition where directions of the irradiation ports were set to be vertical, and upward and downward (i.e., more upward or downward than in the vertical direction), and a percentage of the upward and downward directions being changed. The honeycomb formed body 1 was conveyed in a state of being placed on the drying tray (conveying pallet 24) so that one of the opening end surfaces of the honeycomb formed body 1 might be directed in the conveying direction thereof as shown in FIGS. 9A and 9B. The results are shown in Table 2. It is to be noted that in Table 2, the maximum water amount difference between in the measurement position 1 and in the measurement position 9 shown in FIG. 7B was defined as the water amount difference. In addition, in Comparative Example 2, the arrangement of the waveguides is similar to that in Comparative Example 1, but the placed state of the honeycomb formed body 1 of Comparative Example 2 is different from that in Comparative Example 1 (the honeycomb formed body 1 was conveyed in a state of being vertically placed in Comparative Example 1, and laterally placed in Comparative Example 2).

TABLE 2

Figure 8B:
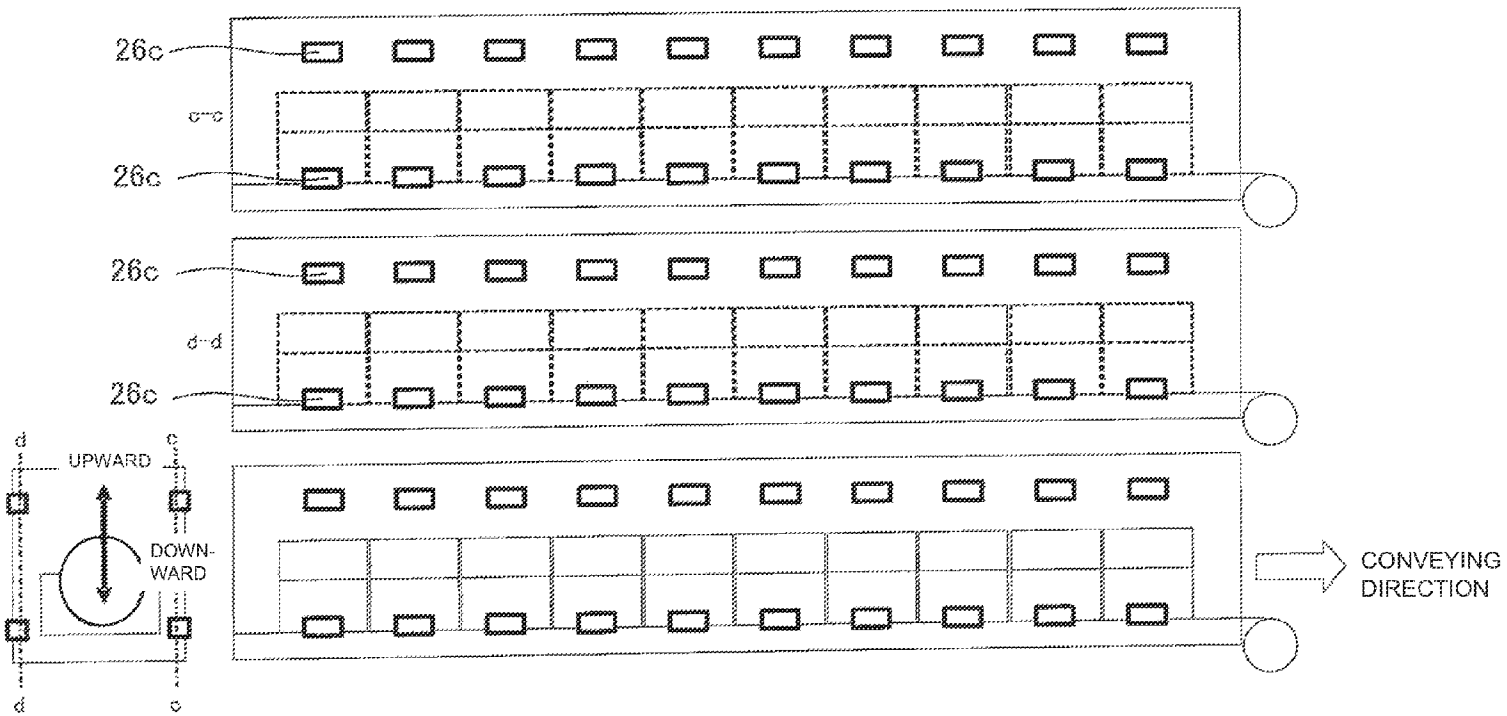
FIG. 8B is a schematic view showing arrangement of the waveguides when the conventional drying apparatus for the honeycomb formed bodies is viewed from a side, in which an embodiment is shown that conveys honeycomb formed bodies in a state of being laterally placed.

| | Corresponding drawing | Percentage of upward and downward directions | The number of upward directions | The number of downward directions | Percentage of upward directions | Water amount difference | The number of cracks |
|---|---|---|---|---|---|---|---|
| Comparative Example 2 | FIG. 8B | 0% | 0 | 0 | 0% | 12% | 10/11 pieces |
| Example 8 | FIG. 9A | 20% | 4 | 4 | 50% | 9% | 5/11 pieces |
| Example 9 | — | 30% | 6 | 6 | 50% | 6% | 0/10 pieces |
| Example 10 | FIG. 9B | 50% | 10 | 10 | 50% | 0% | 0/10 pieces |
| Example 11 | — | 70% | 14 | 14 | 50% | −6% | 0/10 pieces |
| Example 12 | — | 80% | 16 | 16 | 50% | −9% | 5/10 pieces |

Setting the percentage of the upwardly and downwardly directed waveguides to be 20 to 80% allowed the water amount difference to be reduced and the number of cracks to be decreased. Particularly, when the percentage of the upwardly and downwardly directed waveguides was 30 to 70%, cracks did not occur, and good results were obtained.

Examples 13 to 16

Figure 11:
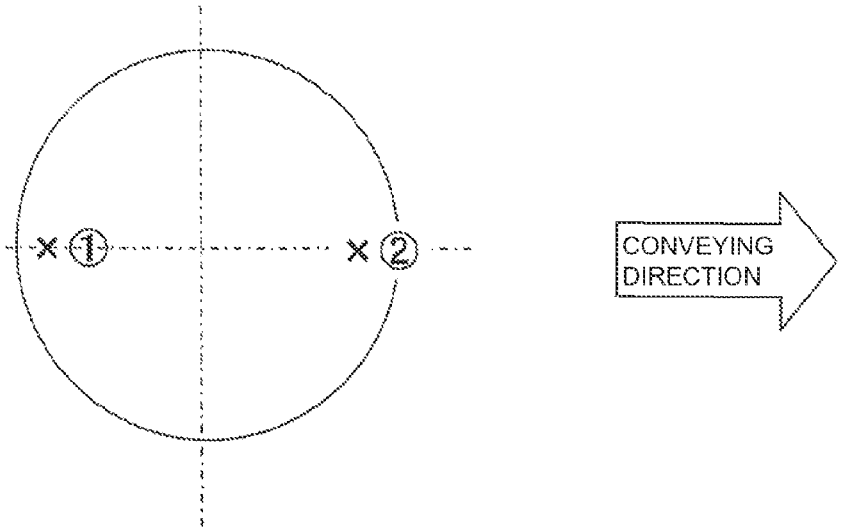
FIG. 11 is a view for illustrating measurement points of water amount differences in Table 3.

Next, microwave drying was performed under a condition where a percentage of the upstream and downstream directed waveguides was changed with the percentage of parallelly directed ones set to be 50%. The results are shown in Table 3. It is to be noted that a water amount difference in Table 3 indicates a water amount difference between a front surface side and a rear surface side of the honeycomb formed body 1 in the conveying direction thereof as shown in FIG. 11.

TABLE 3

| | Corresponding drawing | Percentage of parallel directions | The number of upstream directions | The number of downstream directions | Percentage of upstream directions | Water amount difference | The number of cracks |
|---|---|---|---|---|---|---|---|
| Example 3 | FIG. 3C | 50% | 10 | 10 | 50% | 0% | 0/10 pieces |
| Example 13 | — | 50% | 6 | 14 | 30% | 8% | 3/10 pieces |
| Example 14 | FIG. 10A | 50% | 8 | 12 | 40% | 3% | 0/10 pieces |
| Example 15 | FIG. 10B | 50% | 12 | 8 | 60% | −3% | 0/10 pieces |
| Example 16 | — | 50% | 14 | 6 | 70% | −8% | 3/10 pieces |

When the percentage of the upstream directed waveguides was 40 to 60%, cracks did not occur, and good results were obtained.

A drying apparatus for ceramic formed bodies according to the present invention can be suitably utilized as drying means for honeycomb formed bodies (unfired bodies) in a process of manufacturing high-quality honeycomb structures that are widely used for various filters etc. including DPFs and catalyst carriers.

What is claimed is:

1. A drying apparatus for a honeycomb formed body, that is capable of obtaining a dried honeycomb formed body by irradiating with microwaves and microwave-heating an undried honeycomb formed body as the undried honeycomb formed body which is composed of a raw material composition containing a ceramic material and water, and in which a plurality of cells is partitioned and formed by partition walls, and thereby evaporating water from an inside and an outside of said undried honeycomb formed body to dry said undried honeycomb formed body, the drying apparatus comprising:

a drying chamber having a drying space to store said undried honeycomb formed body;

a microwave generator generating said microwaves to be irradiated to the undried honeycomb formed body that is stored in said drying chamber is radiated; and a plurality of waveguides for introducing the microwaves generated by said microwave generator into said drying chamber, wherein on side surfaces of said drying chamber, provided is a plurality of microwave introduction ports for introducing the microwaves generated by said microwave generator into said drying space inside the drying chamber, said waveguides are disposed at said microwave introduction ports, and irradiation ports of said waveguides are provided directed to two or more different directions toward said drying space of said drying chamber.

2. The drying apparatus for a honeycomb formed body according to claim 1, wherein flanges are formed for removably holding said waveguides provided toward said drying space at said microwave introduction ports on the side surfaces of said drying chamber.

3. The drying apparatus for a honeycomb formed body according to claim 2, wherein said waveguides are formed into a bent shape to change directions of said microwaves in said drying chamber and have flanges for allowing the flanges to be removable from said flanges of said drying chamber, and the radiation directions of said microwaves can be changed depending on attachment directions of said waveguides to said flanges of said drying chamber.

4. The drying apparatus for a honeycomb formed body according to claim 1, which is a continuous drying apparatus that continuously introduces/discharges a plurality of said honeycomb formed bodies into/from said drying chamber, wherein said irradiation ports of said waveguides are provided parallel or vertical with respect to a conveying direction of said honeycomb formed bodies in said drying chamber.

5. The drying apparatus for a honeycomb formed body according to claim 4, wherein a percentage of the parallel direction of the waveguides is 30 to 70%.

6. The drying apparatus for a honeycomb formed body according to claim 5, wherein a percentage of an upstream direction in said conveying direction of said parallelly directed waveguides is 40 to 60%.

7. The drying apparatus for a honeycomb formed body according to claim 1, which is a continuous drying apparatus that continuously introduces/discharges a plurality of said honeycomb formed bodies into/from said drying chamber, wherein the directions of said irradiation ports of said waveguides are set in vertical directions with respect to the conveying direction of said honeycomb formed bodies in said drying chamber and in upward/downward directions to be more upward or downward than said vertical directions, and a percentage of the upward/downward directions is 30 to 70%.

8. The drying apparatus for a honeycomb formed body according to claim 7, wherein a percentage of the upward waveguides in said upward and downward waveguides is 50%.

9. A drying method for honeycomb formed bodies using a drying apparatus for a honeycomb formed body according to claim 1, wherein said honeycomb formed bodies are conveyed with an interval therebetween not less than twice as long as a distance between said irradiation ports.

10. A drying method for honeycomb formed bodies using a drying apparatus for a honeycomb formed body according to claim 4, wherein said honeycomb formed bodies are conveyed with an interval therebetween not less than twice as long as a distance between said irradiation ports.

11. A drying method for honeycomb formed bodies using a drying apparatus for a honeycomb formed body according to claim 7, wherein said honeycomb formed bodies are conveyed with an interval therebetween not less than twice as long as a distance between said irradiation ports.

* * * * *